US010525299B1

(12) United States Patent
Leath et al.

(10) Patent No.: US 10,525,299 B1
(45) Date of Patent: Jan. 7, 2020

(54) TRAINING SLED

(71) Applicant: DEMON SLED LLC, Cedar Park, TX (US)

(72) Inventors: Chad Amos Leath, Natchitoches, LA (US); Yancy Lawrence Culp, Cedar Park, TX (US); Jaylon B. Plunkett, Cedar Park, TX (US); Benjamin Paul Robinson, Lago Vista, TX (US)

(73) Assignee: DEMON SLED, LLC, Cedar Park, TX (US)

( * ) Notice: Subject to any disclaimer, the term of this patent is extended or adjusted under 35 U.S.C. 154(b) by 79 days.

(21) Appl. No.: 15/689,579

(22) Filed: Aug. 29, 2017

Related U.S. Application Data

(63) Continuation-in-part of application No. 14/698,612, filed on Apr. 28, 2015, now Pat. No. 9,744,396, (Continued)

(51) Int. Cl.
*A63B 21/012* (2006.01)
*A63B 71/06* (2006.01)
(Continued)

(52) U.S. Cl.
CPC ..... *A63B 21/012* (2013.01); *A63B 21/0004* (2013.01); *A63B 21/00065* (2013.01); *A63B 21/028* (2013.01); *A63B 21/0552* (2013.01); *A63B 21/0618* (2013.01); *A63B 21/4033* (2015.10); *A63B 21/4035* (2015.10); *A63B 21/4047* (2015.10); *A63B 23/047* (2013.01); *A63B 24/0062* (2013.01); *A63B 69/345* (2013.01); *A63B 71/0054* (2013.01); *A63B 71/0622* (2013.01); *A63B 2071/0063* (2013.01); *A63B 2071/0694* (2013.01); *A63B 2208/0204* (2013.01); *A63B 2220/40* (2013.01); *A63B 2220/44* (2013.01); *A63B 2220/62* (2013.01); *A63B 2220/803* (2013.01); *A63B 2220/833* (2013.01); *A63B 2225/09* (2013.01); *A63B 2225/093* (2013.01); *A63B 2225/50* (2013.01)

(58) Field of Classification Search
CPC ..... A63B 21/12; A63B 21/0004; A63B 21/00058; A63B 21/00061; A63B 21/00065; A63B 21/012; A63B 21/0552; A63B 21/06; A63B 21/1476; A63B 21/1484; A63B 21/1492; A63B 69/34; A63B 69/345; A63B 23/047; A63B 2071/025
See application file for complete search history.

(56) References Cited

U.S. PATENT DOCUMENTS 3,216,724 A * 11/1965 Williams ..... A63B 69/345 473/445
4,140,315 A * 2/1979 Page, Jr. ..... A63B 21/0615 473/445
(Continued)

*Primary Examiner* — Megan Anderson

(57) ABSTRACT

A training sled configurable for adding weights in some embodiments to increase friction and provide for weight-training by lifting portions of the sled. Sled components are slidably or pivotably connected to permit lifting a shoulder member of the sled to different heights and to achieve an optimal training angle. The training sled having an accelerometer, sensor unit and display for sensing, determining and displaying the force of impact and movement of the training sled.

13 Claims, 26 Drawing Sheets

Related U.S. Application Data which is a continuation-in-part of application No. 13/179,441, filed on Jul. 8, 2011, now Pat. No. 9,017,189.

(51) Int. Cl.

| | |
|---|---|
| ***A63B 21/00*** | (2006.01) |
| ***A63B 21/06*** | (2006.01) |
| ***A63B 71/00*** | (2006.01) |
| ***A63B 69/34*** | (2006.01) |
| ***A63B 23/04*** | (2006.01) |
| ***A63B 21/02*** | (2006.01) |
| ***A63B 21/055*** | (2006.01) |
| ***A63B 24/00*** | (2006.01) |

(56) References Cited

U.S. PATENT DOCUMENTS

| | | | | |
|---|---|---|---|---|
| 6,050,906 | A * | 4/2000 | Stout | A63B 69/345 473/438 |
| 6,761,650 | B1 * | 7/2004 | Dettmann | A63B 69/345 473/441 |
| 6,942,585 | B1 * | 9/2005 | Krause | A63B 69/002 473/445 |
| 7,322,893 | B2 * | 1/2008 | Bright | A63B 69/345 473/441 |
| 7,377,883 | B1 * | 5/2008 | Blanton | A63B 21/00192 273/456 |
| 7,527,568 | B2 * | 5/2009 | Joseph | A63B 69/345 473/422 |
| 8,360,938 | B2 * | 1/2013 | Gilman | A63B 21/0615 482/51 |

* cited by examiner

TRAINING SLED

CROSS-REFERENCE TO RELATED APPLICATIONS

The present disclosure is a continuation-in-part of and claims priority to U.S. patent application Ser. No. 14/698,612, titled TRAINING SLED, filed on Apr. 28, 2015, issued U.S. Pat. No. 9,744,396, issued on Aug. 29, 2017 and to U.S. patent application Ser. No. 13/179,441, titled TRAINING SLED, filed on Jul. 8, 2011, issued U.S. Pat. No. 9,017,189, issued on Apr. 28, 2015, the entire contents of which are incorporated by reference herein.

BACKGROUND

The present disclosure relates to resistance based exercise equipment, and particularly to training sleds.

RELATED ART DESCRIPTIONS

Training sleds are used by athletes for resistance training. Athletes can push the training sleds to promote physical conditioning.

BRIEF DRAWING DESCRIPTIONS

SUMMARY OF DISCLOSED EMBODIMENTS

Figure 1:
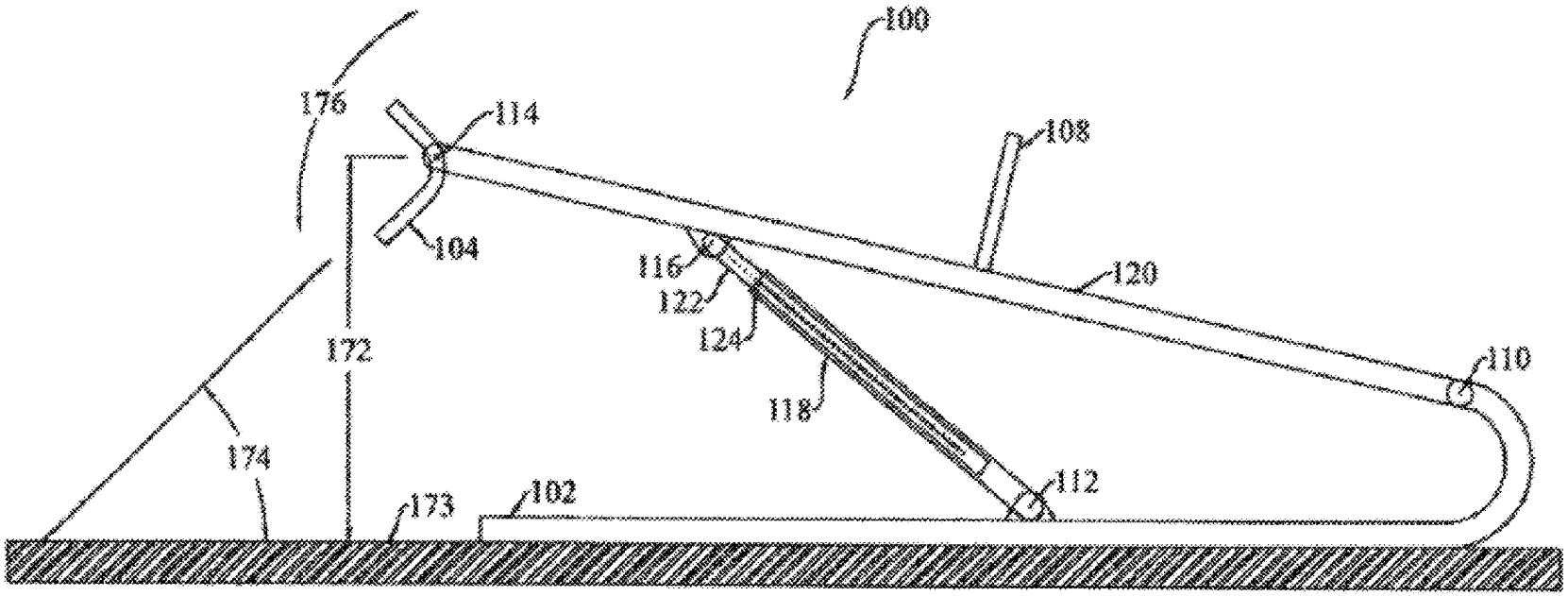
FIG. 1 depicts a side view of an embodied training sled at a first height.

An exemplary embodiment is a training sled comprising an upper member connected to a shoulder member. The shoulder member contacts an athlete's shoulders and may be padded. The shoulder member is positioned on the training sled and formed (e.g., formed at a 90.degree. angle) to promote the athlete using the training sled at an optimized training angle (e.g., a 45.degree. angle) to the ground. The athlete's use of the training sled at the optimized training angle simulates actual running conditions ideal for obtaining top speed as a sprinter, for example. The optimized training angle and arrangement (e.g., height and angle of rotation) of the shoulder member also encourages an athlete while using the training sled to pump his or her arms in a manner that conditions the athlete for faster running in competition. Further, the optimized training angle and arrangement of the shoulder member encourages proper hip placement while using the sled. Accordingly, the upper member positions the shoulder member at a height and angle of rotation for the athlete that achieves the optimized training angle for the athlete. For a sprinter in some scenarios, the height of the sprinter's shoulders when the sprinter is running at a 45.degree. angle (an example optimized training angle) to the ground determines the height at which to set the shoulder member.

In addition to the upper member and shoulder member, the training sled further includes a friction member pivotably connected to the upper member and a cross member. The cross member provides support and rigidity between the friction member and upper member. The cross member is extendable and pivotably connected to the upper member via a cross member union. The cross member union may comprise a lap joint and a pin (i.e., a cross member pin) that permits the cross member to rotate compared to the upper member as the cross member is extended during use of the training sled or height adjustments of the training sled. The cross member is also pivotably connected to the friction member. Therefore, the cross member is adjustable to promote the shoulder member contacting the athlete at the optimized training angle for a particular training regimen.

In some embodiments, the training sled includes one or more weight holders that results in additional resistance between the friction member and a training surface. For example, the weight holder may be used for adding weight in amounts that increase friction to a desired amount on training surfaces such as grass or a gymnasium floor. The weight holder may be connected to the upper member, the friction member, or the shoulder member. In another scenario, the weight holder provides weight lifting type resistance for the athlete. Accordingly, the weight holder can be connected to the upper member, and the cross member pin can be positioned (e.g., removed from a cross member hole and placed in a cross member extender hole) to permit the cross member to extend upward a given distance and to prevent the cross member from contracting passed a desired point (i.e., from dropping too far). The athlete can perform shoulder presses while grasping the upper member or shoulder member, for example. This results in the athlete lifting weights held by the weight holder. In another scenario, resistance elements (e.g., rubber resistance band) can be connected between the friction member and upper member to provide resistance when extending the cross member. Chains can be fastened to the upper member or weight holder to provide both added friction with the training surface when pushing the sled and providing weight for when the athlete presses the upper member overhead.

A similar embodiment is a sled including a shoulder member for contacting an athlete when the athlete is at an optimized training angle to a training surface. The sled further includes an upper member coupled to the shoulder member. A friction member is coupled to the upper member via a cross member. In some embodiments, the sled includes a weight holder coupled to the upper member or friction member. Likewise, the cross member may be pivotable relative to the friction member. The upper member may be connected to and pivotable relative to the friction member, and the cross member may be extendable via a cross member extender. The cross member extender may slide within the cross member and be connected to the cross member via a cross member pin. The cross member pin can be removed and replaced for adjusting the shoulder member for contacting different athletes at an optimized training angle for each athlete. In some embodiments, the shoulder member is pivotable compared to the upper member. The shoulder member may be pivotable within a range during operation, and otherwise fixed to promote the athlete using the sled at the optimize training angle for that athlete or for a particular training regimen. An extendable cross member and adjustable shoulder member promotes achieving the optimized training angle for an athlete and accordingly promotes desired athlete conditioning.

Another embodiment is a service for providing a sled (and related training instruction) that includes a friction member and a shoulder member adjustable to height and shaped to promote a user pushing the sled at an optimized training angle. The service may include adjusting the sled by extending a cross member so the athlete contacts the shoulder member while running and pushing the sled with an optimized training angle to the training surface of about 45.degree. Alternatively, the optimized training angle may be another angle between about 40.degree. and 60.degree., for example. The service may include providing weights (e.g., steel weights, chains) for the sled to increase friction between the friction member and training surface. The service may also include providing the weights to permit the athlete to press a portion of the sled (e.g., through overhead presses). For example, the athlete may press a portion of the sled overhead in a military-press type exercise while the friction member remains substantially motionless in the lateral direction compared to the training surface (as compared to when the sled is pushed across ground or other training surface). In another exercise, the sled may be pushed simultaneously across the ground while performing military-press type exercises and the like.

Another embodiment of a resistance training sled, comprising, a pair of upper members, each having first and second ends and independently adjustable for length relative to each other, a pair of friction members slidably contacting a surface and each pivotably connected to one of the second ends of the upper members, respectively, a pair of adjustable shoulder members, each pivotably positioned on one of the first ends of the upper members, respectively, the shoulder member adjustable to provide optimized angles with respect to the surface, at least one extendable cross member pivotably connected between at least one of the pair of upper members and at least one of the pair of friction members, wherein the at least one cross member provides support and rigidity between the at least one friction member and the at least one upper member, and one or more weight holders attached to at least one of the pair of friction members and the at least one upper member or at least one of the pair of upper members, an accelerometer connected to at least one of the pair of upper members, wherein the accelerometer is utilized to measure a first acceleration of the resistance training sled, a sensor module connected to at least one of the pair of upper members, the sensor module electrically connected to the accelerometer to determine a first directional acceleration of the resistance training sled with respect to the surface and a display connected to at least one of the pair of upper members, the display electrically connected to the sensor module to display at least one of the first acceleration and the determined first directional acceleration.

In yet another embodiment of a resistance training sled, comprising, a three axis accelerometer connected to one of the pair of upper members, the three axis accelerometer is utilized to measure a first acceleration of the resistance training sled, a second axis of the three axis accelerometer measures a transverse horizontal acceleration and a third axis of the three axis accelerometer measures a transverse vertical acceleration, a sensor package coupled to and housing the three axis accelerometer, a first coupling connecting the sensor package to the training sled, a sensor module connected to the training sled, the sensor module electrically connected to the three axis accelerometer to determine a first directional acceleration of the resistance training sled with respect to a surface, a second coupling connecting the sensor module to the training sled, a display connected to at least one of the training sled, the display electrically connected to the sensor module to display at least one of the first acceleration and the determined first directional acceleration and a third coupling connecting the display to the training sled.

DESCRIPTION OF EMBODIMENTS

Embodied systems include a training sled that promotes a user operating the training sled at an optimized training angle. FIG. 1 depicts an exemplary sled 100 that is adjustable to achieve an optimized training angle (e.g., 45.degree.) while used by an athlete. Sled 100 includes a friction member 102 which contacts training surface 173. Training surface 103 may be an outdoor surface such as grass, dirt, asphalt, or artificial grass. Training surface 103 may also be an indoor surface such as a gymnasium floor. A coating (not depicted) may be added to the friction member to affect (i.e., increase or decrease) the resistance when sliding sled 100 across training surface 173.

As shown, sled 100 includes upper member 120, which is connected to or in communication with shoulder member 104. Shoulder member 104 contacts an athlete's shoulders and is positioned to maintain an optimized training angle 174 of the athlete during use. The optimized training angle is the angle between the athlete and training surface 173 as the athlete effectively leans into shoulder member 104 while using the sled. For example, for a sprinter, an optimized training angle may be 45.degree. In FIG. 1, the optimized training angle would be achieved by ensuring training angle 174 is 45.degree. compared to training surface 173 during use of the sled by the sprinter. Accordingly, as depicted in FIG. 1, sled 100 is adjusted to height 172 (e.g., 4'8") for a particular sprinter to achieve a value of 45.degree. as the optimized training angle 174. So when the sprinter leaned into shoulder member 104 to push sled 100 to the right of the page, height 172 would contact the athlete's shoulders as the athlete pumped his or her hands as when running.

As shown in FIG. 1, sled 100 includes upper member 120 connected to or communicatively coupled to shoulder member 104. As shown, shoulder member 104 is connected by shoulder member union 114. Shoulder member union 114 may include a bolt, weld, or other form of connection to upper member 120. In some embodiments, shoulder member union 114 permits adjustment of shoulder member 104 to promote optimized training angle 174 (e.g., 45.degree.) for a particular height 172 (e.g., 5'1" shoulder height). In other embodiments, shoulder member union 114 may permit rotation of shoulder member 104 within a range (e.g., a range permitting an optimized training angle range of between 40.degree. and 60.degree. between the athlete and training surface) while operating sled 100.

Cross member 118 adjusts (e.g., extends, contracts, stretches, compresses) to allow adjustment of height 172. As shown, cross member 118 is coupled to cross member extender 122. Cross member extender 122 is pivotably (i.e., able to be pivoted) connected to upper member 120 by upper cross member union 116. Likewise, cross member 118 can pivot in relation to friction member 102 by lower cross member union 112. Upper member 120 is pivotably connected to friction member 102 by upper member union 110. Such pivot connections allow changes in height 172 to promote achieving optimized training angle 174. Cross member pin 124 may be placed through a hole in cross member 118 and simultaneously through a particular hole in a series of holes in cross member extender 122 to achieve a desired height 172.

In FIG. 1 sled 100 is illustrated with optional weight holder 108. Weight holder 108 may be stacked with steel weights to increase friction between friction member 102 and training surface 173. In addition, adding weights to weight holder 108 provides downward force on upper member 120 and accordingly to shoulder member 104 as an athlete uses sled 100. At an optimized training angle such as 45.degree., a substantial upward force may be applied by the athlete to shoulder member 104. Adding weights to weight holder 108 may prevent unwanted lifting of sled 100. Weight holder 108 may also be adjustable in directions left to right along sled 100 to achieve, for a given amount of weight added to weight holder 108, a desired amount of friction between friction member 102 and training surface 173 while providing desired down force to an athlete through shoulder member 104.

Sled 100 in FIG. 1 may be used for shoulder presses or leg presses by an athlete. For such cases, sled 100 permits increasing height 172 to a particular height (e.g., the maximum height an athlete can reach with his arms overhead while doing a press), while preventing height 172 from falling below a certain height (e.g., an athlete's shoulder level). Accordingly, cross member extender 122 and cross member 118 may be configured to permit extending their combined effective length while preventing too much contraction of their combined effective length. This may be achieved if cross member pin 124 is installed in a hole in cross member extender 122 but not in cross member 118.

Sled 100 may be fabricated from suitable materials including but not limited to tubular plastics, metals, alloys, synthetic materials, and the like. FIG. 1 depicts a two-axis view of sled 100, which may include a further upper member, cross member, cross member extender, friction member, and so on. For clarity, such additional members are not expressly depicted in FIG. 1, but may be indicated in other figures and described below. Also, FIG. 1 and its components are not necessarily drawn to scale and the proportion of elements compared to each other may change as needed for given applications. In an exemplary embodiment, upper member 120, shoulder member 104, friction member 102, cross member 124, and weight holder 108 are fabricated from a cylindrical alloy (e.g., steel pipe, aluminum pipe, tubular steel). In addition, in this exemplary embodiment, upper member 120, shoulder member 104, friction member 102, cross member 124, cross member extender 122, have corresponding (i.e., further) elements in a third dimension not depicted in the two-axis representation in FIG. 1. Furthermore, friction member 102 and its corresponding friction member (not depicted in FIG. 1) may be distanced from each other wider than the distance between upper member 120 and its corresponding upper member (not depicted in FIG. 1). This increased distance between friction members compared to upper members promotes stability when operating sled 100 and may result in an aesthetically pleasing design. In addition, since the shoulder member 104 (and any corresponding shoulder member in a third dimension not depicted) is connected to upper member 120, the distance between upper members can be a built or adjustable to allow shoulder member 104 and any corresponding shoulder members to comfortably contact an athlete.

Figure 2:
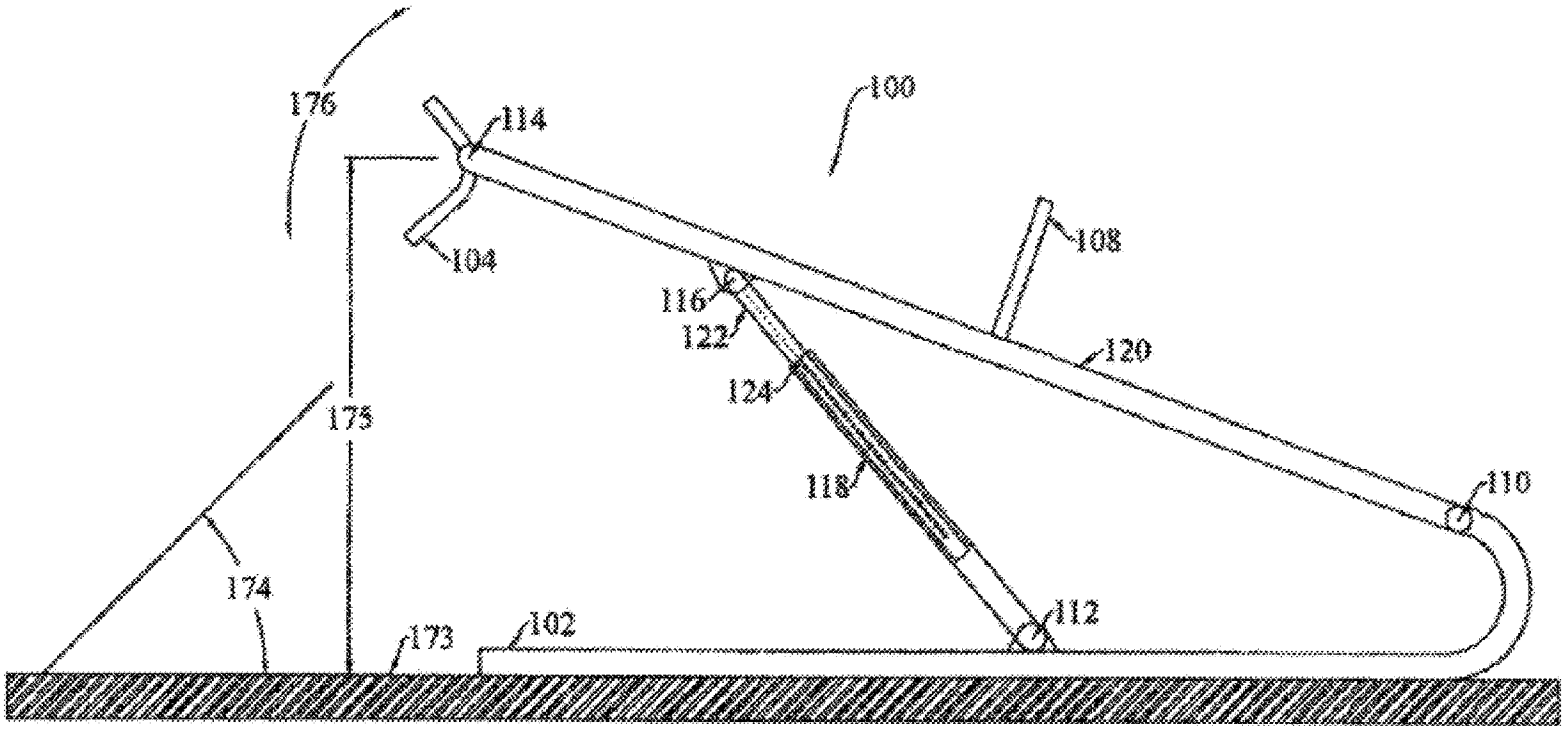
FIG. 2 depicts a side view of an embodied training sled at a second height.

FIG. 2 depicts sled 100 from FIG. 1 with shoulder member 104 at height 175. Height 175 in FIG. 2 is higher than height 172 of shoulder member 104 depicted in FIG. 1. Raising shoulder member 104 can be achieved by removing cross member pin 124 and pressing upward on upper member 120 or shoulder member 104. This causes an effective lengthening of cross member 118, which occurs by cross member extender 122 sliding out of cross member 118. When the desired height 172 is achieved, cross member pin 124 can be replaced through cross member extender 122 and cross member 118. The desired height can be the height for a particular athlete that promotes a training angle 174 of between 40.degree. and 60.degree. This is the optimized training angle for an athlete. For a sprinter, for example, the optimized training angle may be 45.degree. to simulate a sprinter leaving starting blocks and beginning a competitive sprint.

For certain uses of sled 100 in FIG. 2, an optimized training angle (corresponding to training angle 174) for a sprinter is approximately 45.degree. For example, operating sled 100 at a training angle 174 of 45.degree. may promote an improvement in the sprinters speed while simultaneously promoting proper sprinting form. With the sprinter driving his or her shoulders into shoulder member 104 while achieving a training angle 174 of 45.degree. (i.e., an optimized training angle for a particular exercise and athlete), the sprinter can work to have proper arm movement including pumping arms in synchronization with pushing the sled with leg force. Friction member 102 sliding on training surface 173 provides resistance for the sprinter. The resistance is affected by the amount of friction between training surface 173 and friction member 102. The amount of friction is affected by the materials used in making friction member 102, the weight of sled 100, the makeup of training surface 173, and such factors. To adjust the amount of friction and therefore adjust the amount of resistance of sled 100, weight can be added to weight holder 108.

In FIG. 2, the dimensions of the components of sled 100 are not necessarily limited to particular sizes, and the relative sizes and proportions of components of sled 100 are shown as examples and are not meant to necessarily limit claimed embodiments. In a particular embodiment, the length of friction member 102 along training surface 173 is approximately 92" and height 175 is adjusted to contact a 6' tall sprinter when the sprinter is leaning into sled 100 at an optimized training angle of 45.degree. (i.e., training angle 174 is 45.degree.). As shown by arc 176, upper member 120 (and accordingly shoulder member 104) swing through an arc when cross member 118 and cross member extender 122 are extended or retracted during adjustment or during upper body exercises performed with the sled. Upper member union 110 acts as a pivot point for upper member 120, which rotates about upper member 110 during adjustments to achieve training angle 174 as an optimized training angle. Lower cross member union 112 and upper cross member union 116 serve as pivot points for cross member 118 and cross member extender 122. Shoulder member union 114 can be adjusted and fixed in some embodiments to promote restricting an athlete to using sled 100 at a training angle 174 that is an optimized training angle (e.g., 45.degree.). Accordingly, shoulder member union 114 is adjustable and fixable for a particular height 175 so that when an athlete uses sled 100 at the optimized training angle, his shoulders line up with the components of shoulder member 104.

Figure 3:
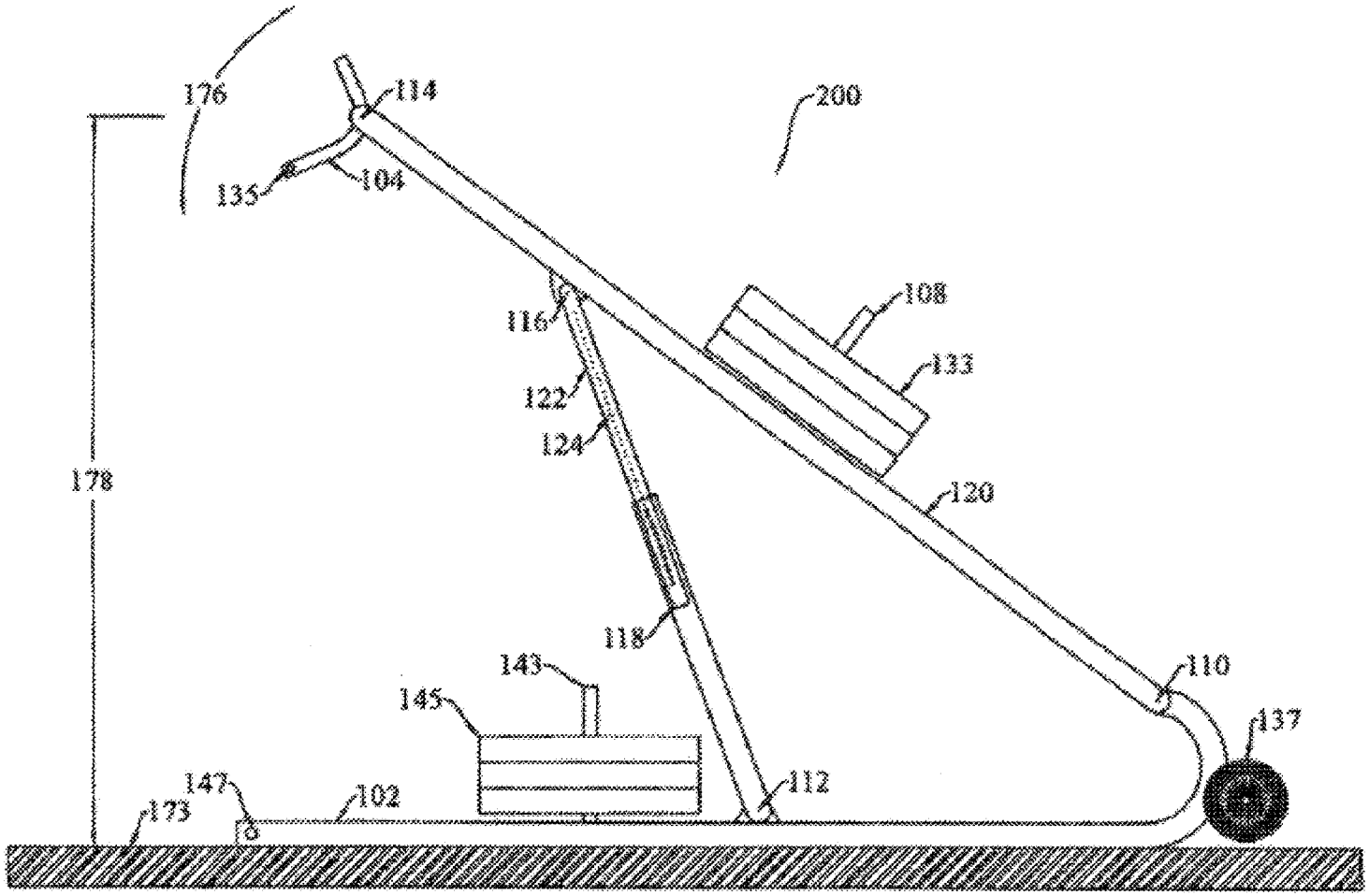
FIG. 3 depicts a side view of an embodied training sled at a third height, with additional features including a wheel and added weights.

In addition to providing resistance training for running, embodied sleds can be used for upper body workouts by the user pressing components overhead, for example. FIG. 3 depicts an embodied sled 200 with further features including weights 133 which are placed on weight holder 108. As shown, height 178 is relatively high, and cross member extender 122 is extended from cross member 118 farther than in FIG. 1 and FIG. 2. An embodied service may include instructing a user to press shoulder member 104 or upper member 120 and associated components overhead through arc 176 to distance 178. Cross member pin 124 can be removed from a hole in cross member 118 to free cross member extender 122 to extend out of cross member 118. Cross member pin 124 can be installed in a hole in cross member extender 122 (while the cross member pin 124 is not installed in a hole in cross member 118) to prevent the upper member (under the weight of weight 133) from dropping too low (e.g., below a user's shoulder height) while permitting a pressing action by an athlete to height 178. For an athlete approximately 6'1" tall, height 178 may be in the range of approximately 6'-8" or 7'-0", but embodied sleds should allow for an acceptable range of motion to accommodate athletes of expected sizes.

Other optional features depicted in sled 200 of FIG. 3 include pressing handle 135 which may be a cylindrical tube (that as depicted would come out of the page) gripped by an athlete to press shoulder member 104 overhead. In such cases, pivotal shoulder member union 114 may be fixed to prevent or limit shoulder member 104 pivoting during pressing motions. Pivot connection 116 and pivot connection 112 provide rotation between cross member components compared to upper member 120 and friction member 102. This allows pressing shoulder member 104 to height 178 and other heights. Pivot connection 116 and pivot connection 112 may include lap joints, pinned connections, hinged connections, flexible connections, and so on, the details of which are not necessarily critical to the function and operation of sled 200 for achieving an optimized training angle with added features for providing alternate pressing exercises.

Also as depicted in FIG. 3, sled 200 includes wheel 137 for more easily moving sled 200 along training surface 173 during certain situations. For example, if sled 200 encounters a hill, wheel 137 may assist an athlete or service provider by allowing for easier passage up the hill. In other situations, a service provider or athlete may pick up sled 200 (or a portion of sled 200) while grasping handle 147 (which as shown may protrude from the page). An embodied service may include instructing an athlete to move the sled forward or backward (right or left as depicted in FIG. 3) while lifting the sled and rolling it on wheel 137. As shown in FIG. 3, lifting sled 200 on wheel 137 could be accomplished by lifting a portion of friction member 102 or by lifting handle 147. Weight 145 positioned on optional weight holder 143 and/or weight 133 positioned on weight holder 108 provides resistance to lifting, and contributes to athlete conditioning.

As shown in FIG. 3, optional weight holder 143 is adapted for removably holding weight 145 for increasing friction between friction member 102 and training surface 173. Alternatively, weight 145 provides resistance when an athlete lifts sled 200 by handle 147 (while other portions of friction member 102 including wheel 137 remain on training surface 173).

Figure 4:
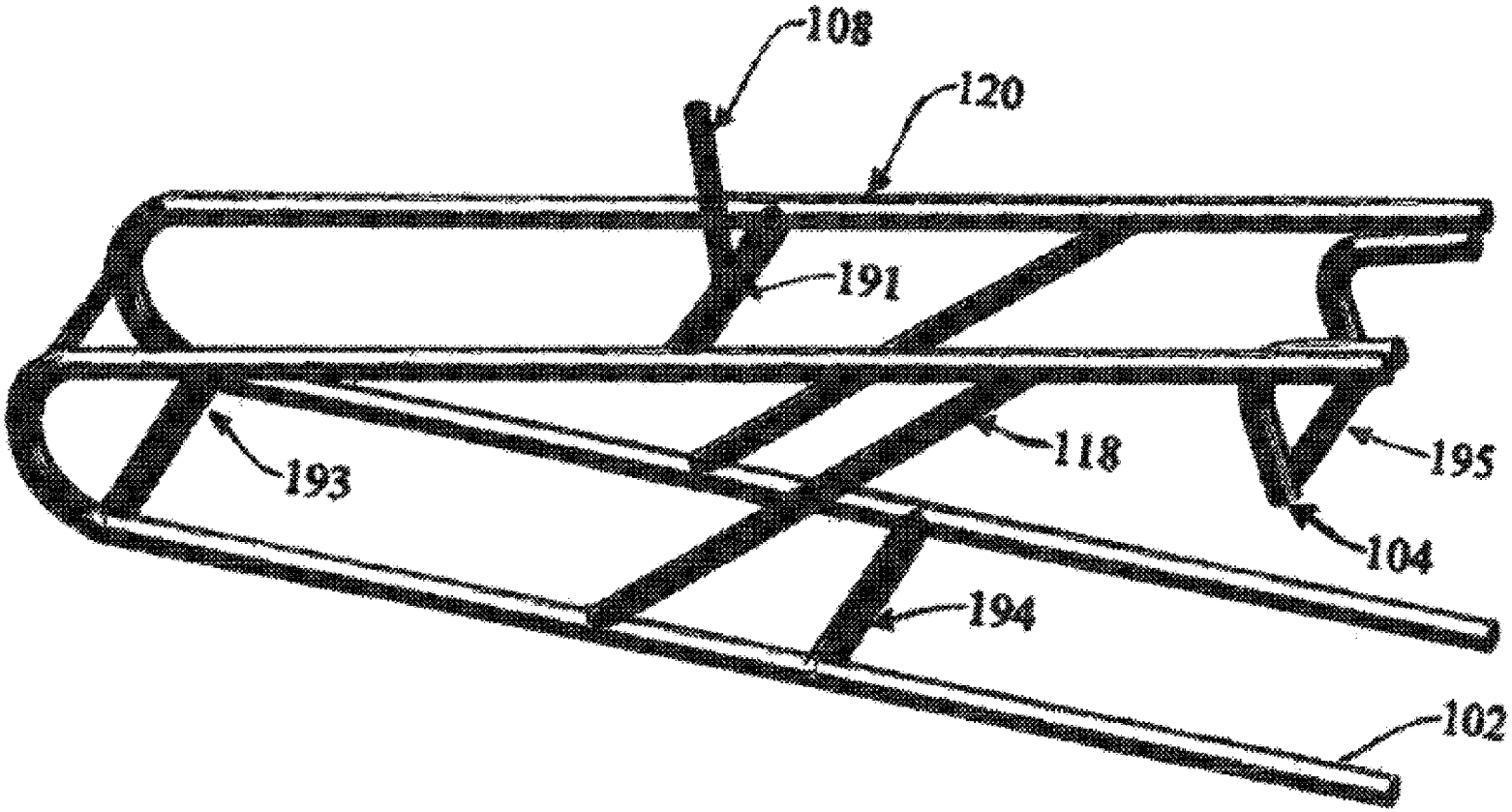
FIG. 4 represents a three axis depiction of features of an embodied training sled.

FIG. 4 depicts, in an arbitrary three axis view, certain features of an embodied sled such as sled 200 (FIG. 3) or sled 100 (FIG. 1 and FIG. 2). Other features (e.g., details of pivot members or cross member 118 used for extending upper member 120) are not depicted in FIG. 4 for simplicity but these details may be incorporated in embodied sleds nonetheless as needed for achieving a sled that promotes an athlete (or series of athletes of different sizes) training at one or more optimized training angles. Support member 194 provides support between friction member 102 and a corresponding friction member depicted. Friction member 102 and its corresponding friction member may be a greater distance apart than the distance between upper member 120 and its corresponding upper member, which are connected to each other by support member 191. As shown, support member 191 also supports optional weight holder 108. As depicted, on the end of friction member 102 toward shoulder member 104, where the athlete would be positioned, farthest from support member 193, the sled may have a wider stance (compared to the end of sled near support member 193). This promotes sled stability during use and may help prevent an athlete from stepping on friction members 102 in certain scenarios and embodiments, like where friction member 102 extends past (toward the right and out of the page) shoulder member 104 and support member 195. Shoulder member 104 and support member 195 are sized to comfortably contact an athlete. Support member 195 and shoulder member 104 may include a pad (not depicted) for comfortably contacting an athlete. As shown, shoulder member 104 is curved for contacting an athlete and may be pivotably connected to upper member 120 to permit adjustment to promote the athlete using the sled at an optimized training angle (e.g., between 40.degree. and 60.degree. to the ground). Additionally, upper member 120, shoulder member 104, support member 195, and cross member 118 may be positioned to allow realistic or exaggerated pumping of the arms by athletes using the sled, to condition the athlete for running conditions and to improve athlete performance. The sled depicted in FIG. 4 may be made of components such as tubular steel or aluminum. Sled 100 may be made of carbon fiber or synthetic materials.

Figure 5:
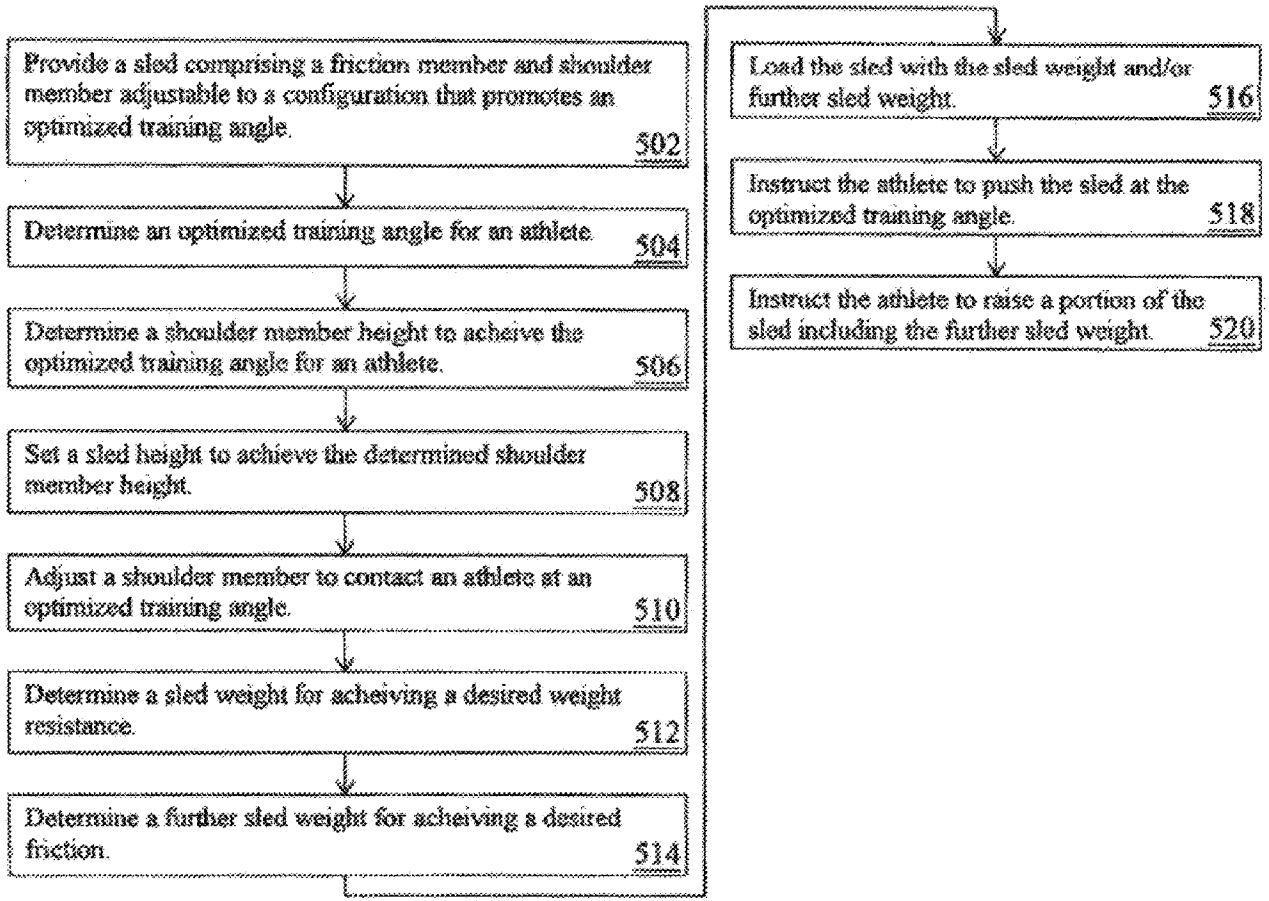
FIG. 5 depicts aspects of an embodied service for a training sled.

FIG. 5 depicts aspects of an embodied method or service for training an athlete including box 502 for providing a sled (e.g., sled 100 in FIG. 1) comprising a friction member and shoulder member adjustable to a configuration that promotes and optimized training angle. Box 504 relates to determining an optimized training angle for an athlete. The optimized training angle may be different for conditioning an athlete for various objectives, such as improving quickness out of racing blocks, improving acceleration, improving top speed during a sprint, and the like. For a sprinter to improve an overall speed in an 800 meter race and to promote good form, an optimized training angle of 45.degree. may be used. Box 506 relates to determining a shoulder member height to achieve the optimized training angle for the athlete. This determination may be made mathematically or by observing the athlete during sprinting, by experimentation, or by trial and error, as examples. Box 508 relates to setting a sled height to achieve the determined shoulder member height. For sled 100 in FIG. 1, this may be achieved by removing extension member pin 124 from extension member extender 122 (FIG. 1) and extension member 118 (FIG. 1) and reinstalling through these components once the proper height 172 (FIG. 1) is achieved for shoulder member 104 (FIG. 1). Box 510 relates to adjusting the shoulder member (e.g. shoulder member 104 in FIG. 1) to contact the athlete at the optimized training angle (e.g., an angle 174 of 45.degree. in FIG. 1). Box 512 relates to determining a sled weight for achieving a desired weight resistance for an athlete. Referring to FIG. 3, box 512 may relate to determining an amount of weight 133 for adding to weight holder 108 to provide resistance when an athlete lifts upper member 120 and shoulder member 104 overhead.

Referring to FIG. 5, box 514 is for determining a further sled weight for achieving a desired friction for an embodied sled. In FIG. 3, the weight for achieving the desired friction would be included with weight 145 on weight holder 143. The weight contributes to stability of the sled and contributes to friction between friction member 102 (FIG. 3) and training surface 173 (FIG. 3). The weight also contributes to the overall weight of the sled and prevents an athlete from lifting the sled while using it for resistance during run training. In some embodiments, weight holder 143 is a platform or includes a platform and weight 145 includes body weight from a service provider or other person. Box 516 relates to loading the sled with the sled weight for achieving weight resistance and with the further weight for achieving a desired level of friction between the sled and training surface. Box 518 relates to instructing an athlete to push the sled at an optimized training angle (e.g., 45.degree. for a sprinter). Box 520 relates to instructing an athlete to raise a portion of an embodied sled for resistance training. For example, for sled 200 (FIG. 3), box 520 relates to instructing an athlete to raise shoulder member 104, and accordingly upper member 120, overhead to height 178. This may be achieved by using handle 135, which as shown, extrudes from the page and provides the athlete a lifting mechanism. For such an operation, shoulder member union 114 may be mechanically fixed (e.g., by tightening a bolt/nut combination holding shoulder member 104 to upper member 120, or shoulder member 104 may otherwise rotate to a stopping point against a component (e.g., rubber bumper) of upper member 120.

Figure 6A:
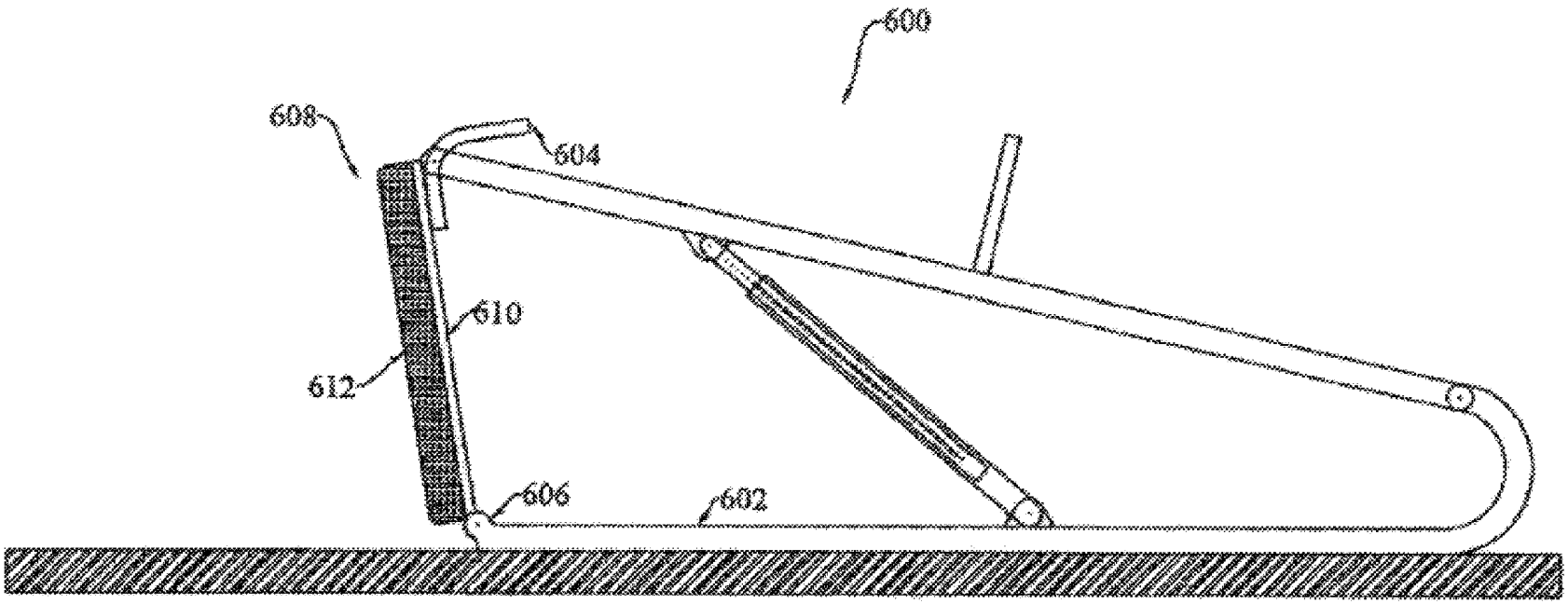
FIGS. 6A and 6B depict aspects of an embodied sled with padding for additional training exercises.

FIG. 6A depicts sled 600 with shoulder member 604, which may be the same or similar to corresponding elements depicted in the other figures. Push member 608 includes push member frame 610 which extends from shoulder member 604 to push member mount 606. As shown, push member mount 606 is integrated into friction member 602. Padding 612 is mounted to push member frame 610. Push member 608 is optionally added to a training sled if football lineman drills, for example, are to be performed during training. A football player, for example, may run drills in which push member 608 simulates an opposing player that is to be blocked or tackled. Push member frame 610 may be rigid or may be made of a flexible material (e.g., plastic, synthetic material, rubber, fiber material) that permits push member 608 to flex when it is hit by an athlete. To this end, push member mount 606 may include a spring or other shock absorbing mechanism (not depicted). As shown, shoulder member 604 is rotated (as compared to shoulder member 104 in FIG. 1) to permit mounting push member 608. To absorb shocks distributed to push member 608, shoulder member 604 and its mount may include spring action (e.g., through a torsion spring, not depicted).

Figure 6B:
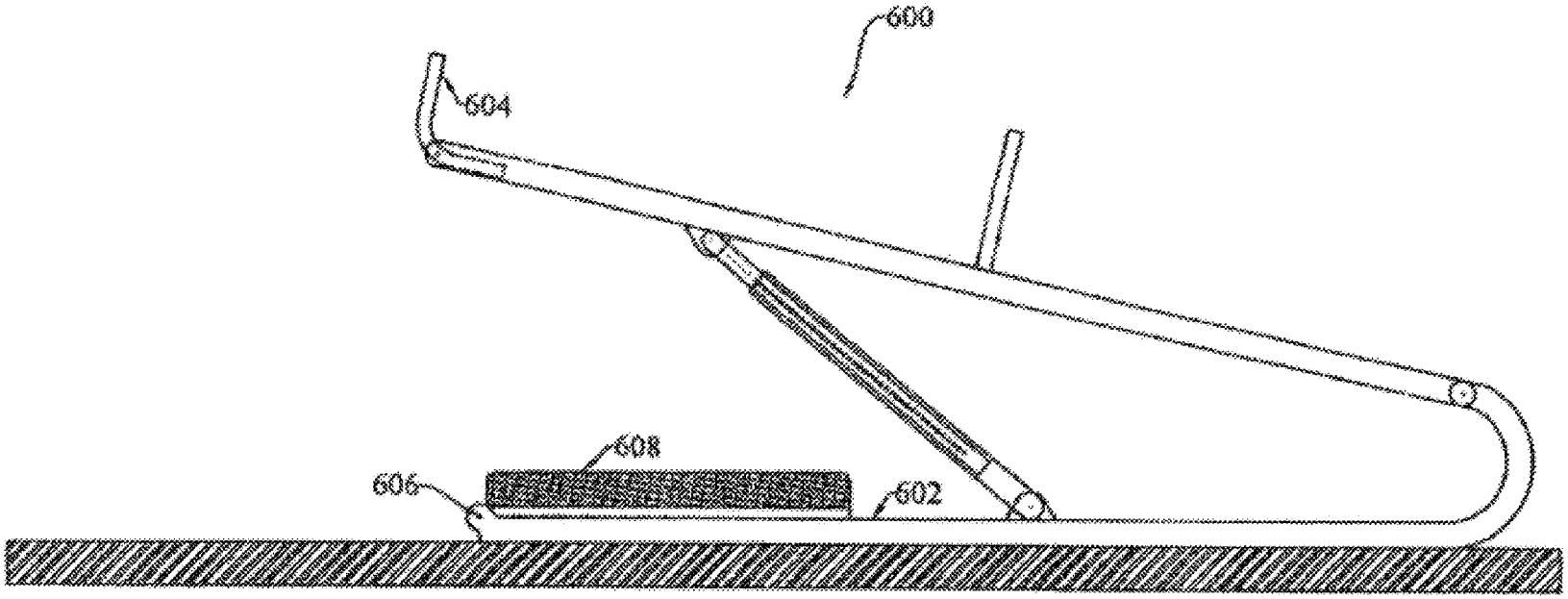

FIG. 6B depicts sled 600 from FIG. 6A with push member 608 rotated for storage. As shown, shoulder member 604 is temporarily rotated at push member mount 606 to permit shoulder member 608 to rotate downward for storage. Push member 608 rests on friction member 602 when not in use, or it can be removed.

Figure 7:
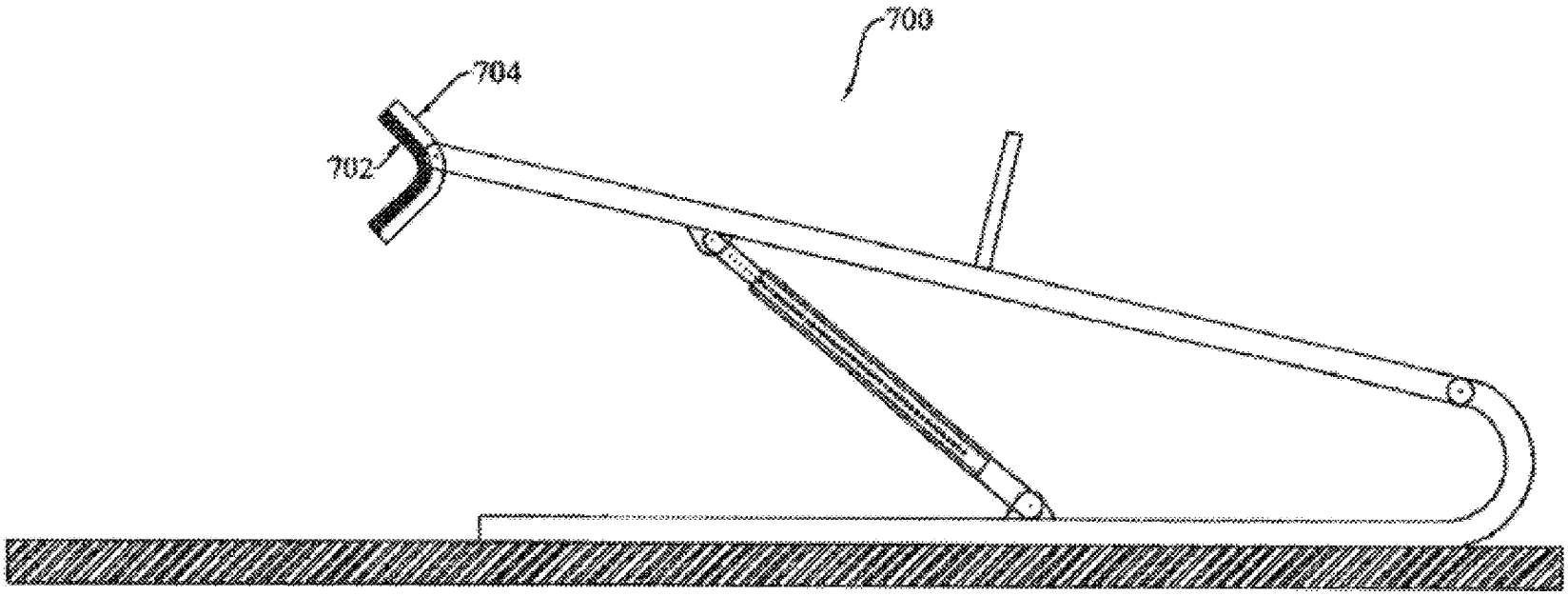
FIG. 7 depicts aspects of an embodied sled with padding for the shoulder member.

FIG. 7 depicts sled 700 with added pad 702. Sled 700 may be identical to or similar to the sleds depicted in the other figures. Pad 702 provides relief to an athlete from having any hard surfaces of shoulder member 704 contacting the athlete's shoulders during use. Foam covered by a synthetic material (e.g., vinyl) may be used for pad 702 and padding 612 (FIG. 6A). Pad 702 and padding 612 may also include colors, logos, or other branding related to the manufacturer or sponsor of sleds 600 and 700. Alternatively or in addition, pad 702 and padding 612 may include colors, logos, and branding related to the provider of services (e.g., training services) in which sleds 600 and 700 are used.

Figure 8:
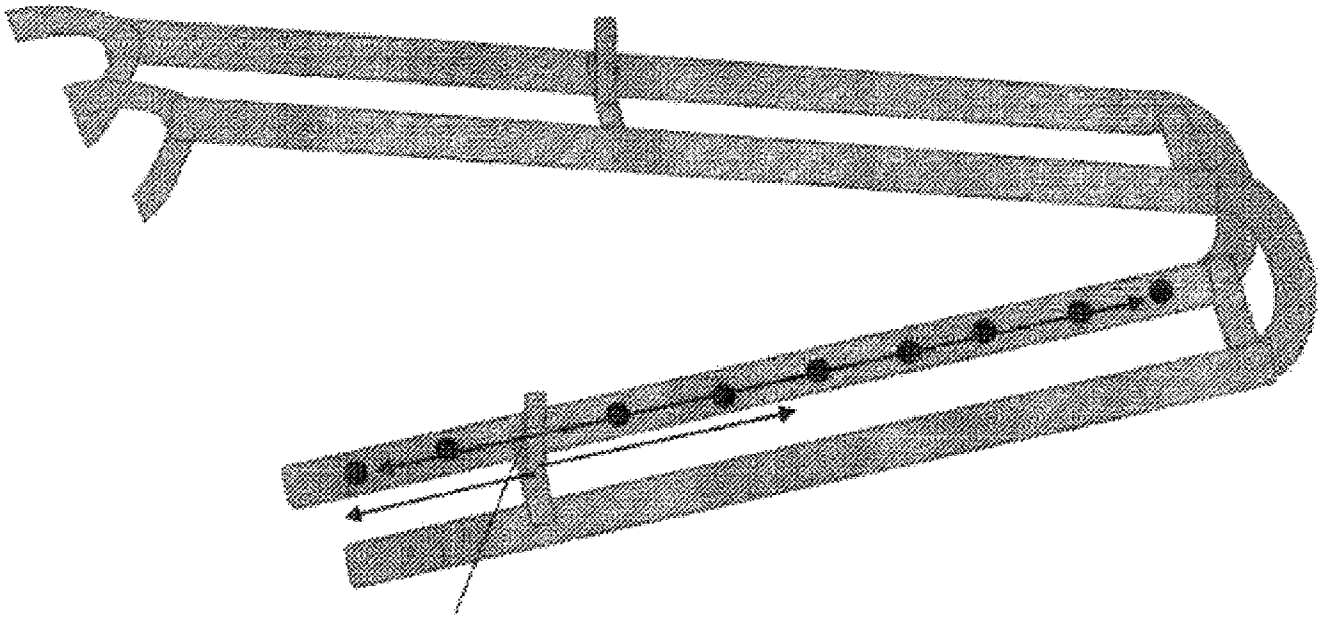
FIG. 8 depicts aspects of an embodied sled with a weight stack on a friction member.

FIG. 8 depicts aspects of an embodied sled with a weight stack on a friction member. One or more weight stacks may be placed at various locations on the friction member. The weight stack may be placed in opposing slots of the friction member and locked in place via one or more pin locks (not shown). In other embodiments, the weight stack may be moved in place via a sliding mechanism (not shown) integrated within the friction member wherein the weight stack is integrated within opposing ends of the friction member. In another embodiment, the weight stack may be integrated within opposing channels (not shown) of the friction member, slide to any location and locked in place via one or more tightening mechanisms (not shown) that may be located on the friction member and/or on the weight stack.

Figure 9:
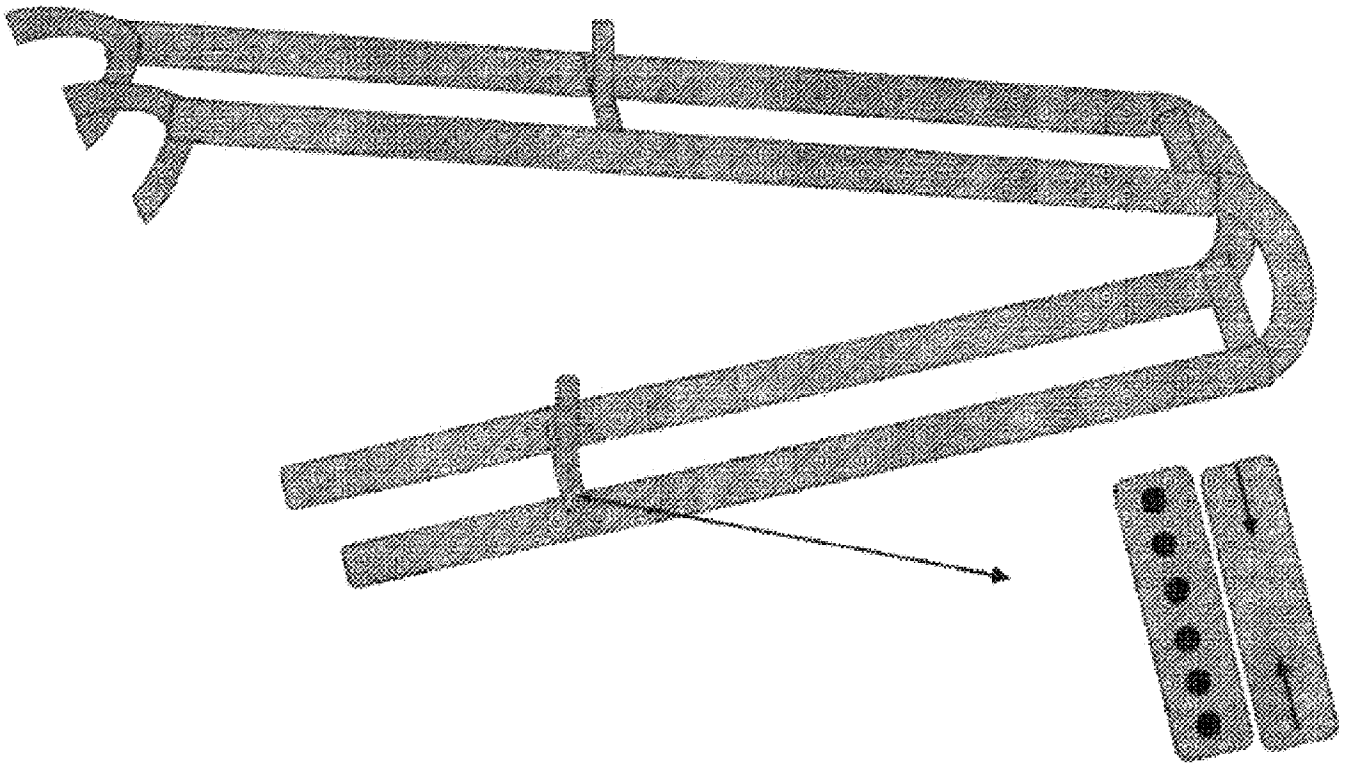
FIG. 9 depicts aspects of an embodied sled with an adjustable support member.

FIG. 9 depicts aspects of an embodied sled with an adjustable support member (although a weight holder is depicted, a support member can be provided in approximately the same location). This support member may be adjusted to different lengths via a pin lock (not shown) or a tightening mechanism (not shown) to change the width of the friction member. In another embodiment, a weight holder with an appropriate width could be integrated with the friction member.

Figure 10:
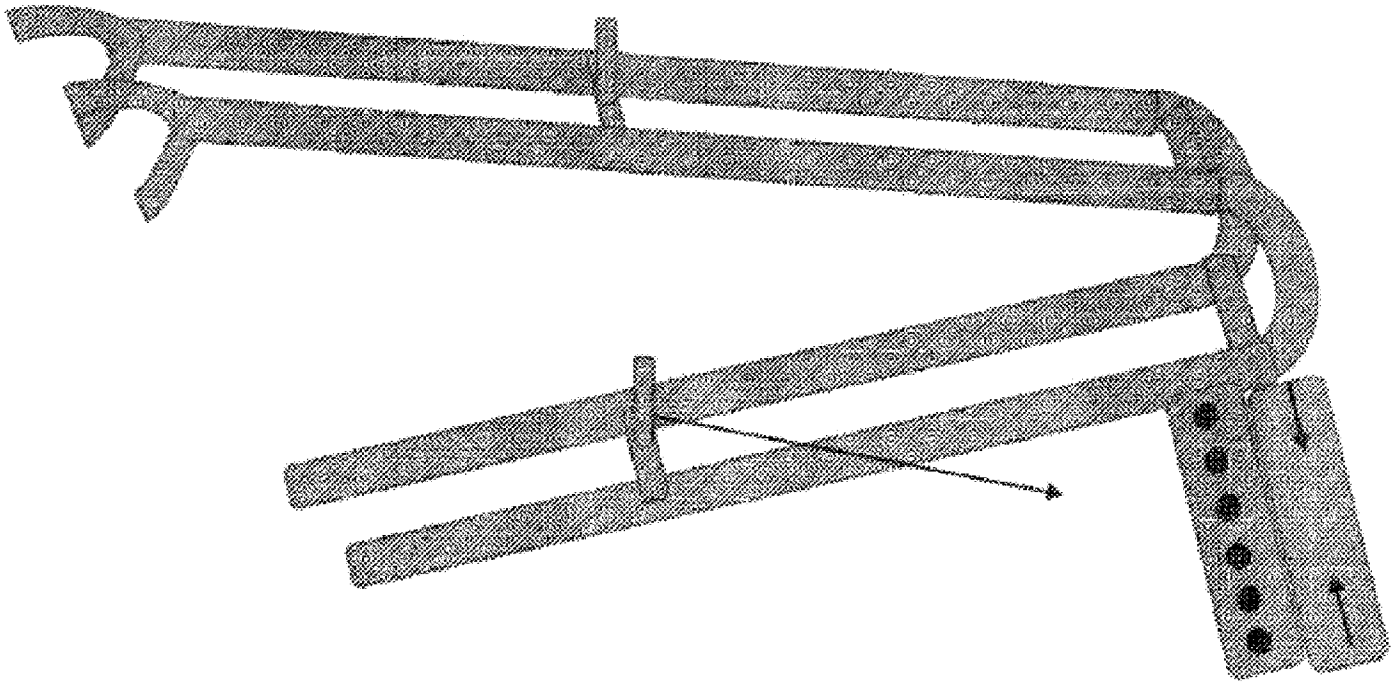
FIG. 10 depicts aspects of an embodied sled with an adjustable weight holder.

FIG. 10 depicts aspects of an embodied sled with an adjustable weight holder. The weight holder may be adjusted in height by extending a vertical portion of the weight holder and holding the vertical portion in place via a pin lock (not shown) or a tightening mechanism (not shown). If the vertical portion were extended, additional weights could be added.

Figure 11:
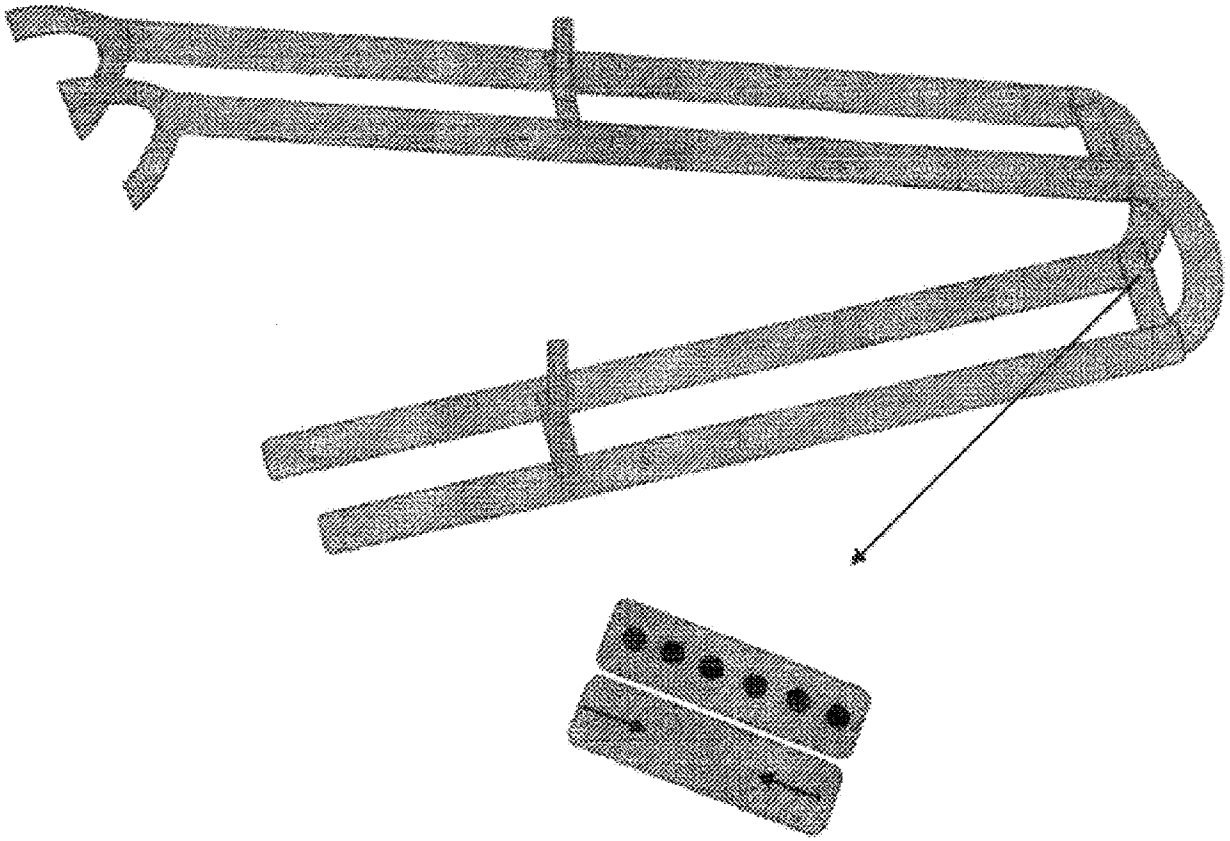
FIG. 11 depicts aspects of an embodied sled with an adjustable support member.

FIG. 11 depicts aspects of an embodied sled with an adjustable support member. This support member may be adjusted in length via a pin lock (not shown) or a tightening mechanism (not shown) to change the length of the friction member. In such a scenario, the weight holder would have to increase in an appropriate length or be removed.

Figure 12:
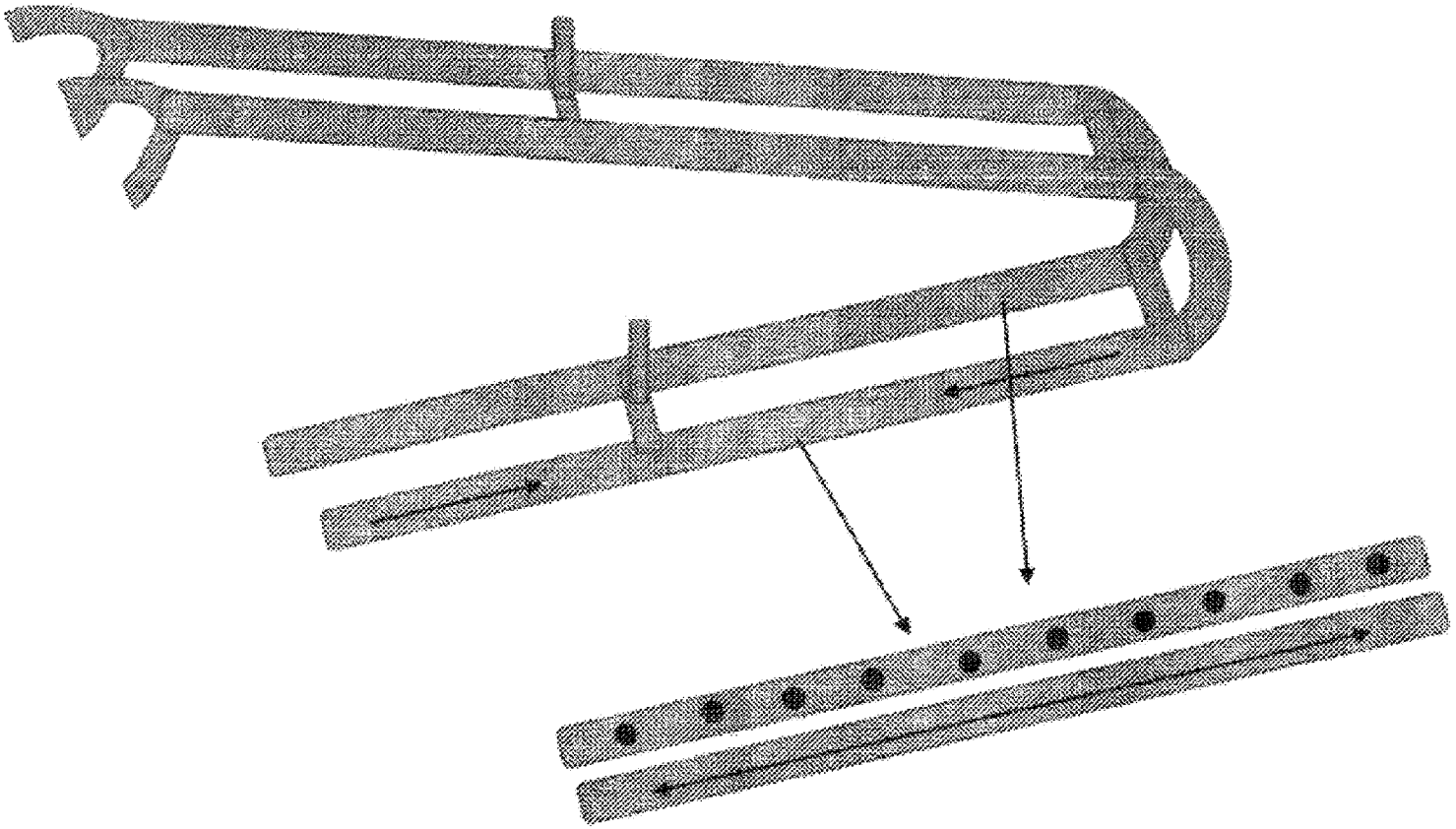
FIG. 12 depicts aspects of an embodied sled with adjustable friction members.

FIG. 12 depicts aspects of an embodied sled with adjustable friction members. Both the left and right friction members can be adjusted in length with one or more ends of each of the friction members telescoping or folding over itself.

Figure 13:
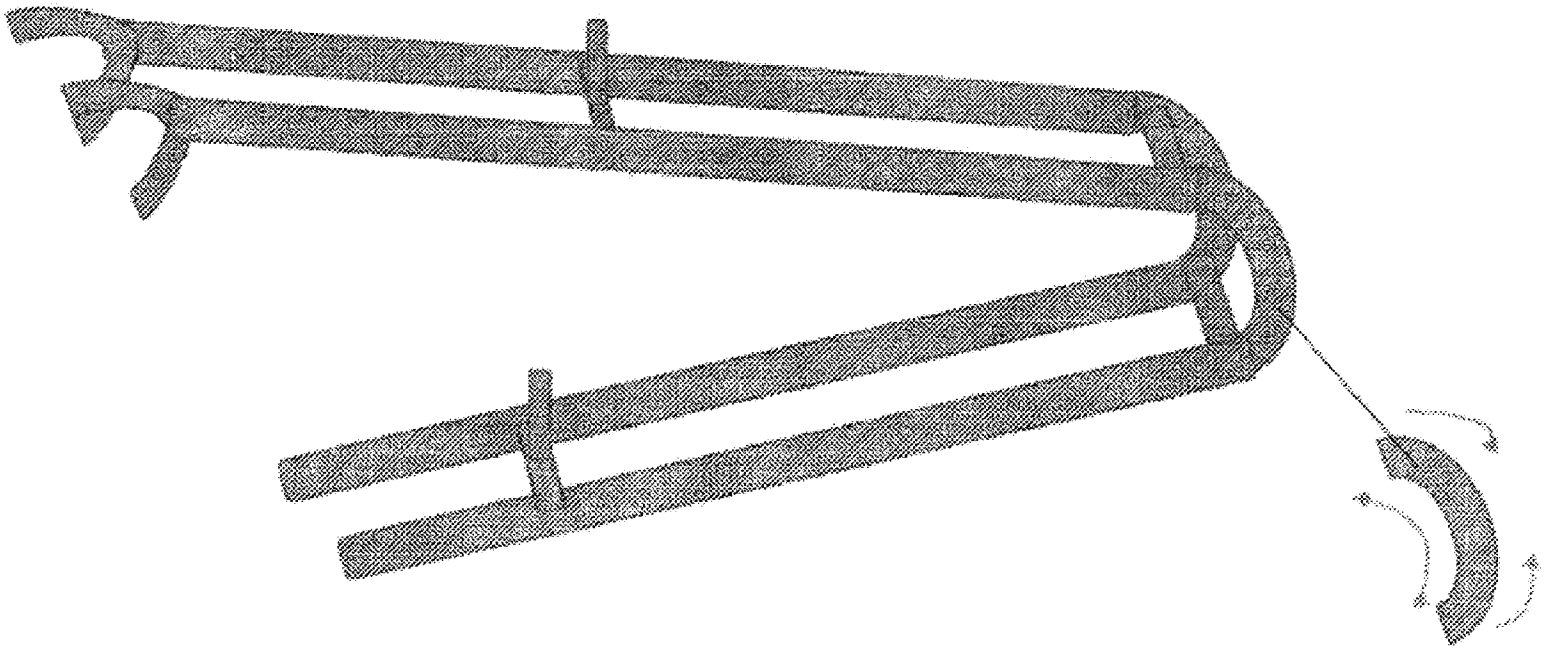
FIG. 13 depicts aspects of an embodied sled with a bendable and adjustable friction member.

FIG. 13 depicts aspects of an embodied sled with a portion that connects at least to the friction member. The front of the friction member may be removable, bendable or adjustable in size.

Figure 14:
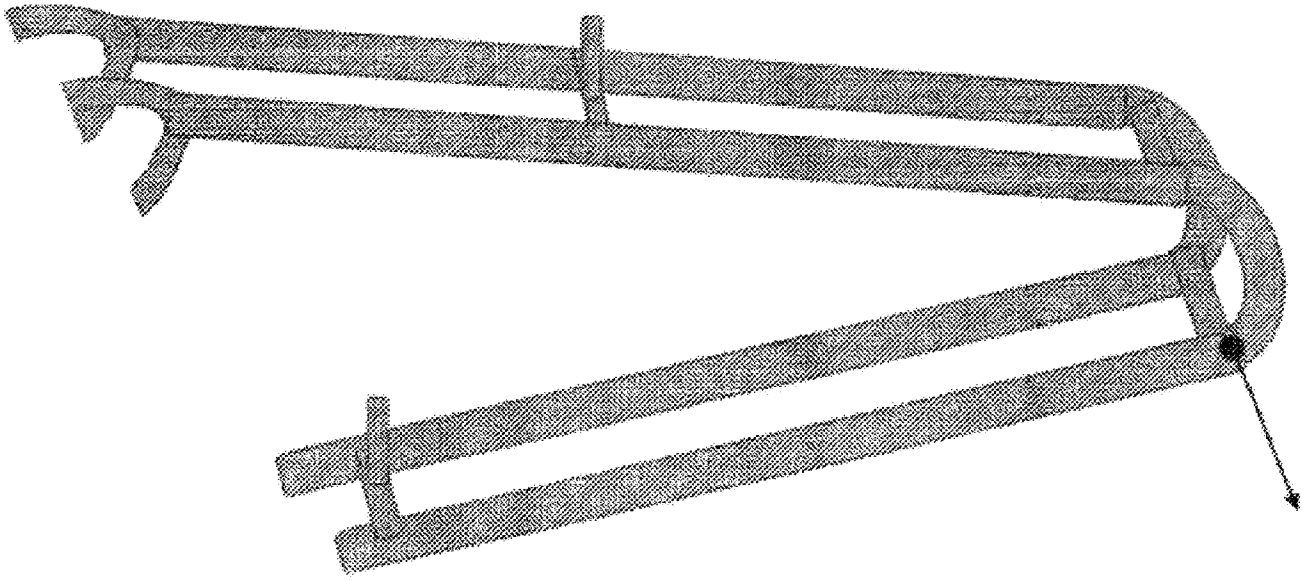
FIG. 14 depicts aspects of an embodied sled with a pivot point for friction members.

FIG. 14 depicts aspects of an embodied sled with a pivot point for friction members. This pivot point allows the left and right friction members to move in all planes of motion.

Figure 15:
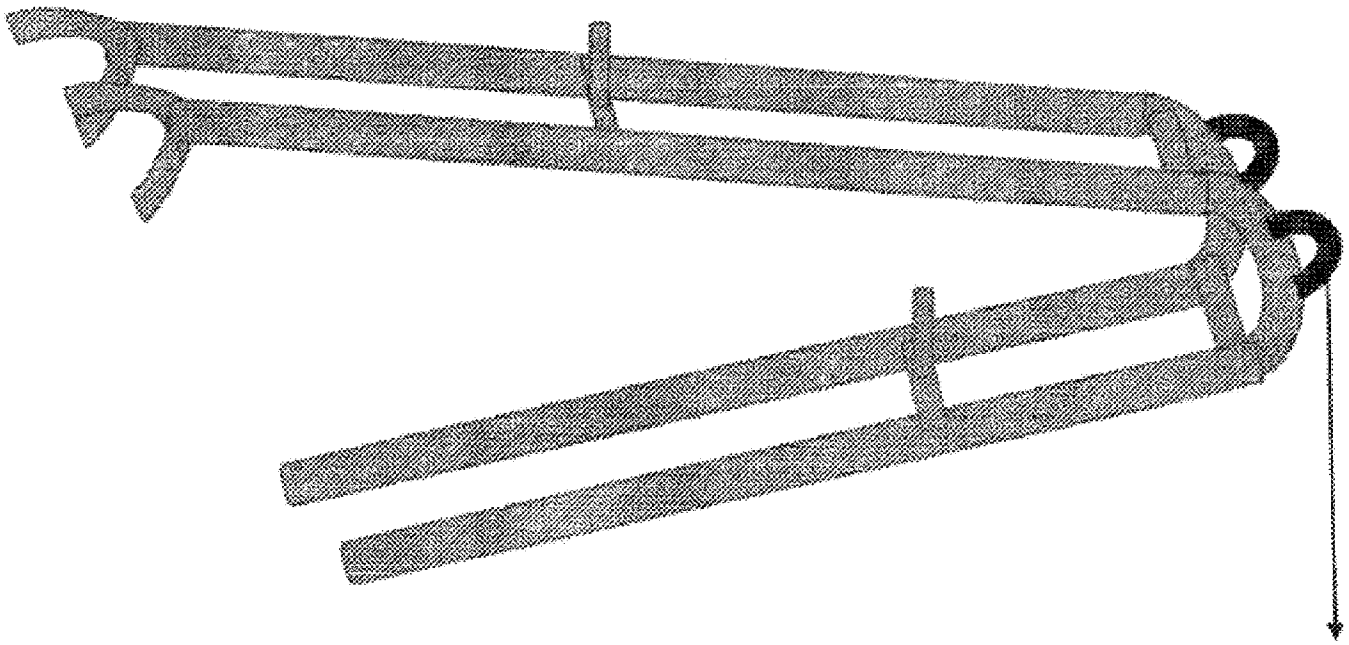
FIG. 15 depicts aspects of an embodied sled with attachable and detachable b-rings.

FIG. 15 depicts aspects of an embodied sled with attachable and detachable b-rings. These D-rings permit the sled to be pulled and may be permanently attached or attachable and detachable anywhere on the sled. Further, as many D-rings as desired can be positioned on the sled.

Figure 16:
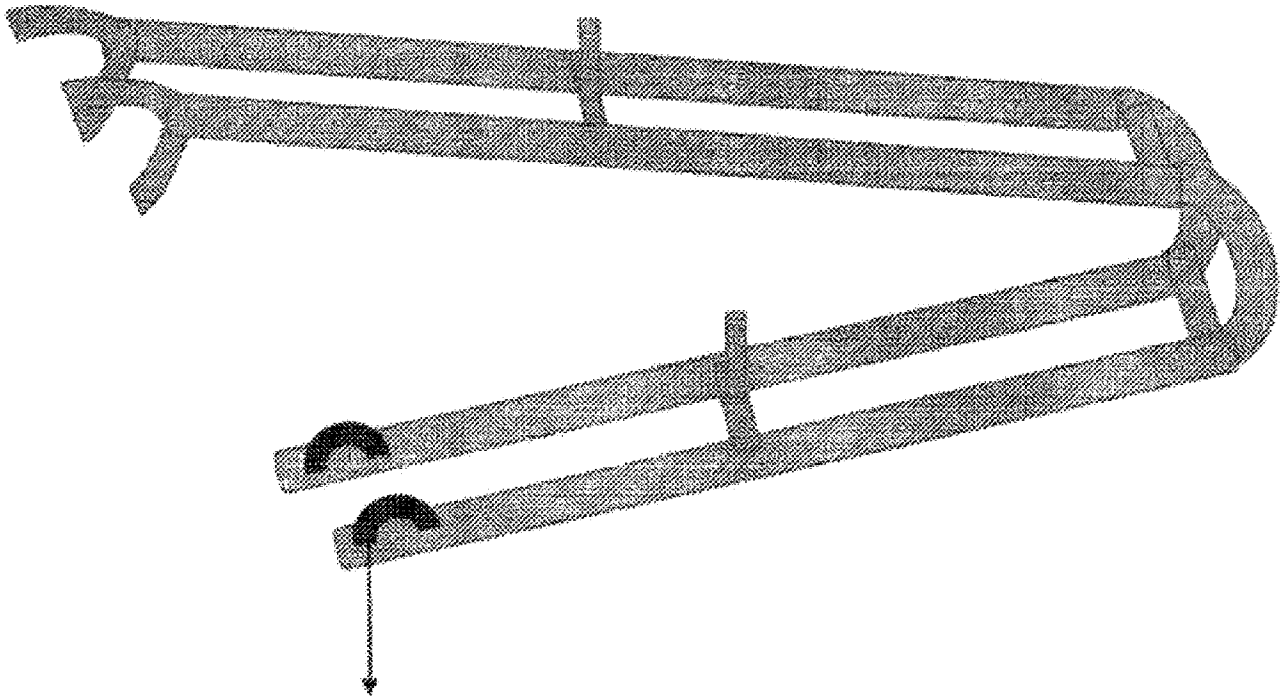
FIG. 16 depicts aspects of an embodied sled with detachable handles.

FIG. 16 depicts aspects of an embodied sled with detachable handles. Handles for lifting the sled may be may be permanently attached or detachable and locatable anywhere on sled. Further, as many handles as desired can be positioned on the sled.

Figure 17:
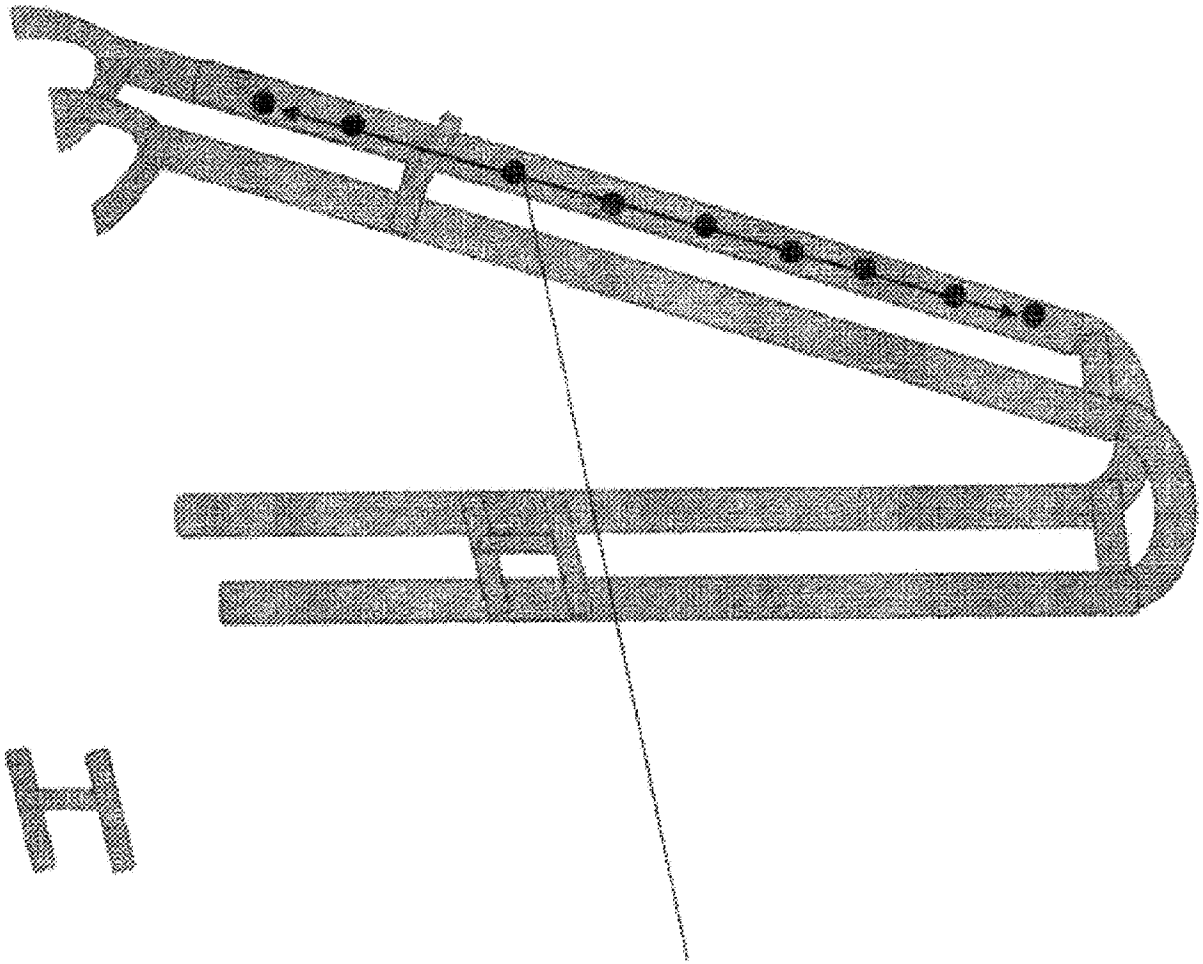
FIG. 17 depicts aspects of an embodied sled with a weight stack.

FIG. 17 depicts aspects of an embodied sled with a weight stack. This weight stack may be placed anywhere on the upper member. The weight stack may be placed in opposing slots of the upper member and locked in place via one or more pin locks (not shown). In other embodiments, the weight stack may be moved in place via a sliding mechanism (not shown) integrated within the upper member wherein the weight stack is integrated within opposing ends of the friction member. In another embodiment, the weight stack may be integrated within opposing channels (not shown) of the upper member, slide to any location and locked in place via one or more tightening mechanisms (not shown) that may be located on the upper member and/or on the weight stack.

Figure 18:
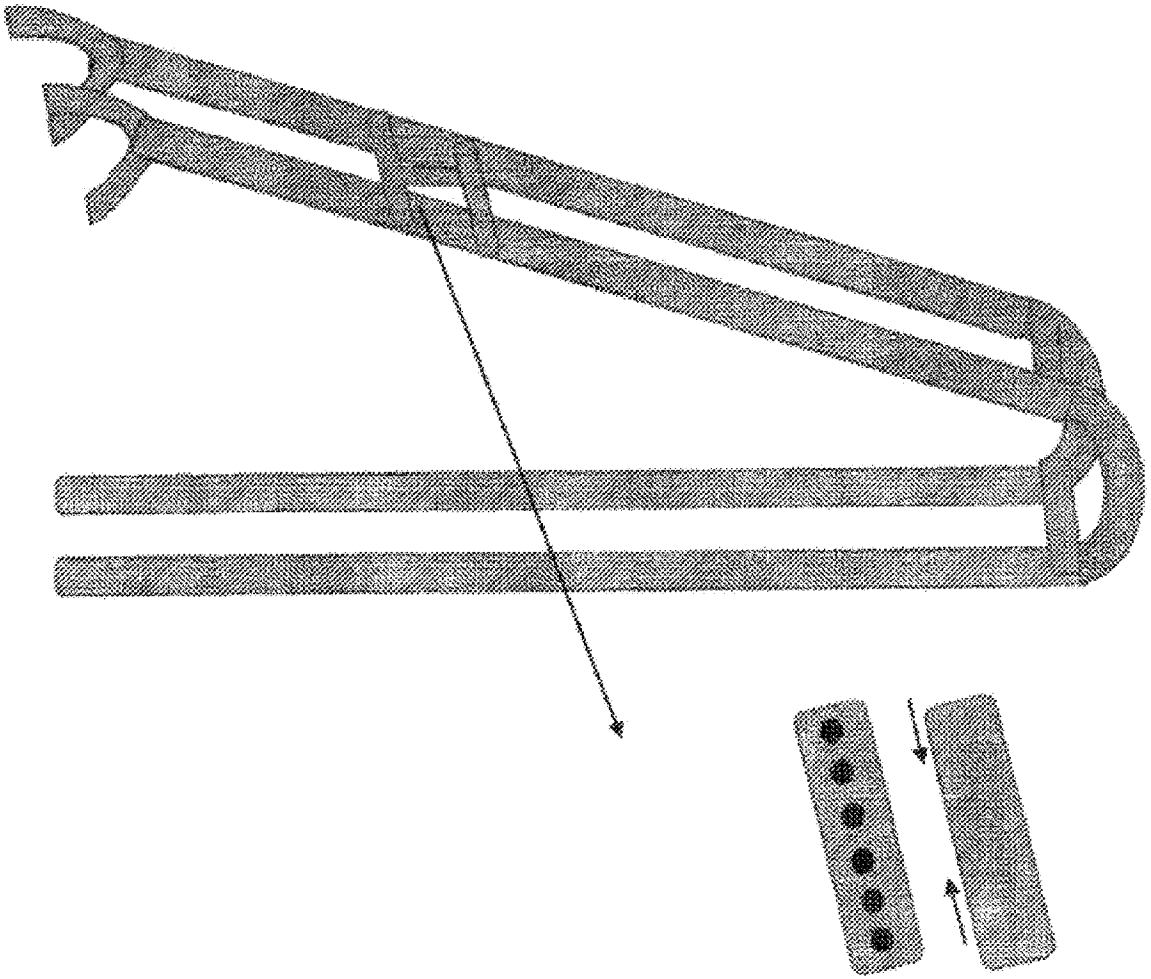
FIG. 18 depicts aspects of an embodied sled with a adjustable support member.

FIG. 18 depicts aspects of an embodied sled with an adjustable support member. This support member may be adjusted to different lengths to change the width of the upper member. This support member may be adjusted to different lengths via a pin lock (not shown) or a tightening mechanism (not shown) to change the width of the upper member. In another embodiment, a weight holder with an appropriate width could be integrated with the upper member.

Figure 19:
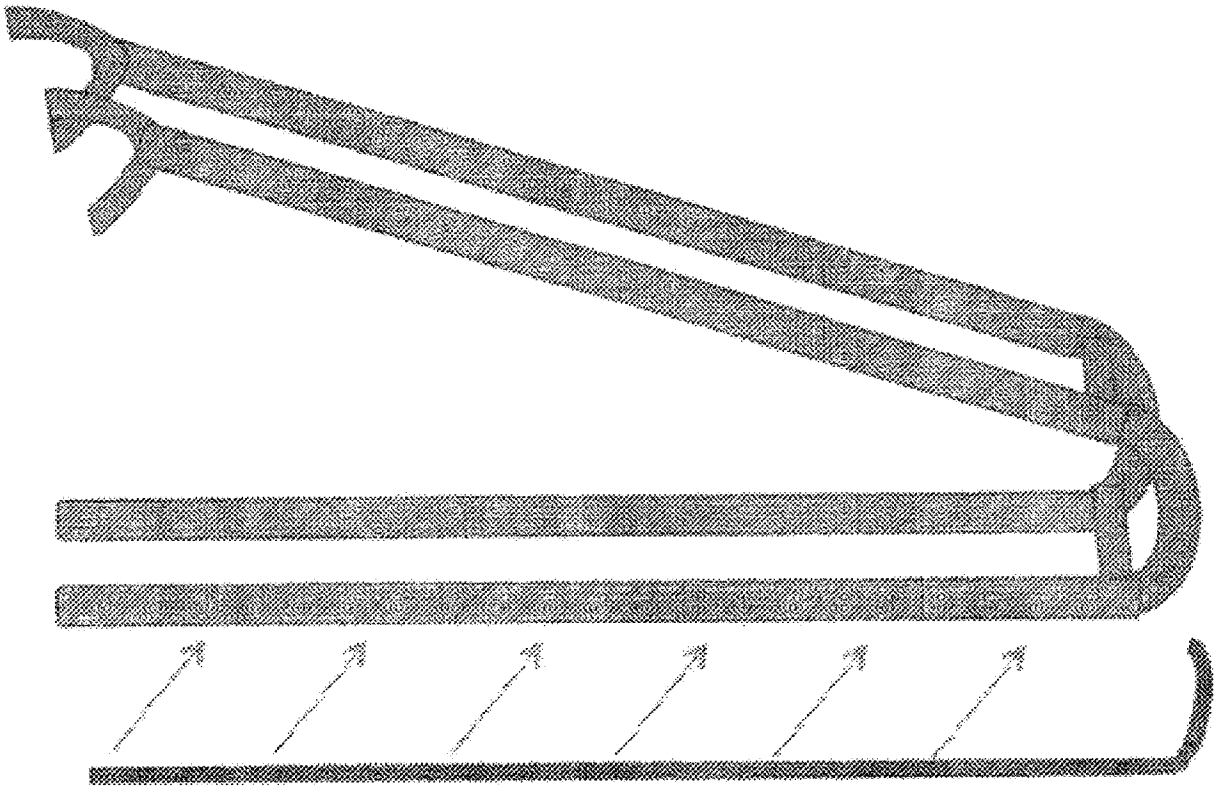
FIG. 19 depicts aspects of an embodied sled with a friction snap-on railing system.

FIG. 19 depicts aspects of an embodied sled with a friction snap-on railing system that is placed on the friction members and the front of the friction member. In other embodiments, the railing system can be placed around and contain the friction members in a sleeve-like manner and may not be connected to or in contact with the front of the friction members and can be permanently affixed to the friction members and may not be connected to or in contact with the front of the friction members. This railing system can be made of differing materials for use on indoor tile, courts and other smooth surfaces so that the sled does not ruin the floor or for use on outdoor surfaces such as grass or dirt.

Figure 20:
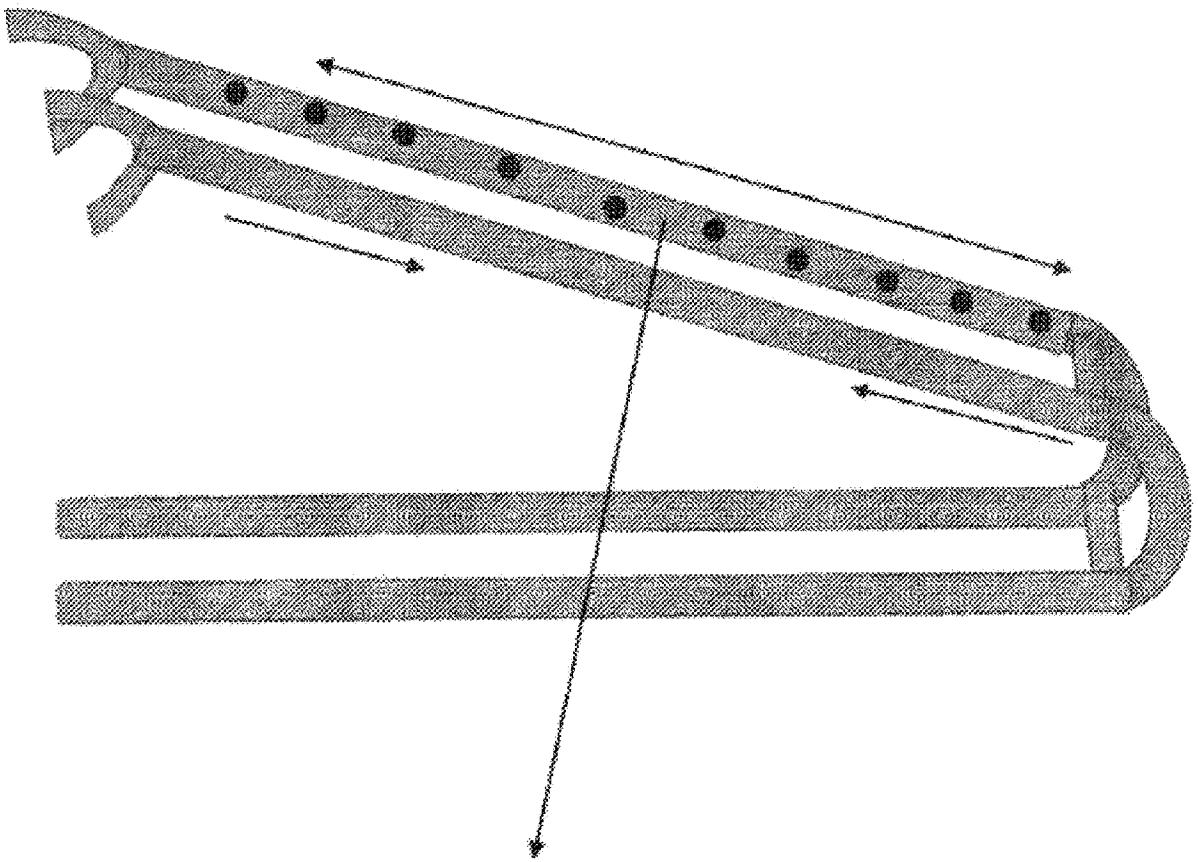
FIG. 20 depicts aspects of an embodied sled with adjustable left and right upper members.

FIG. 20 depicts aspects of an embodied sled with adjustable left and right upper members. Both the left and right upper members can be adjusted in length with one or more ends of each of the left and right upper members telescoping or folding over itself.

Figure 21:
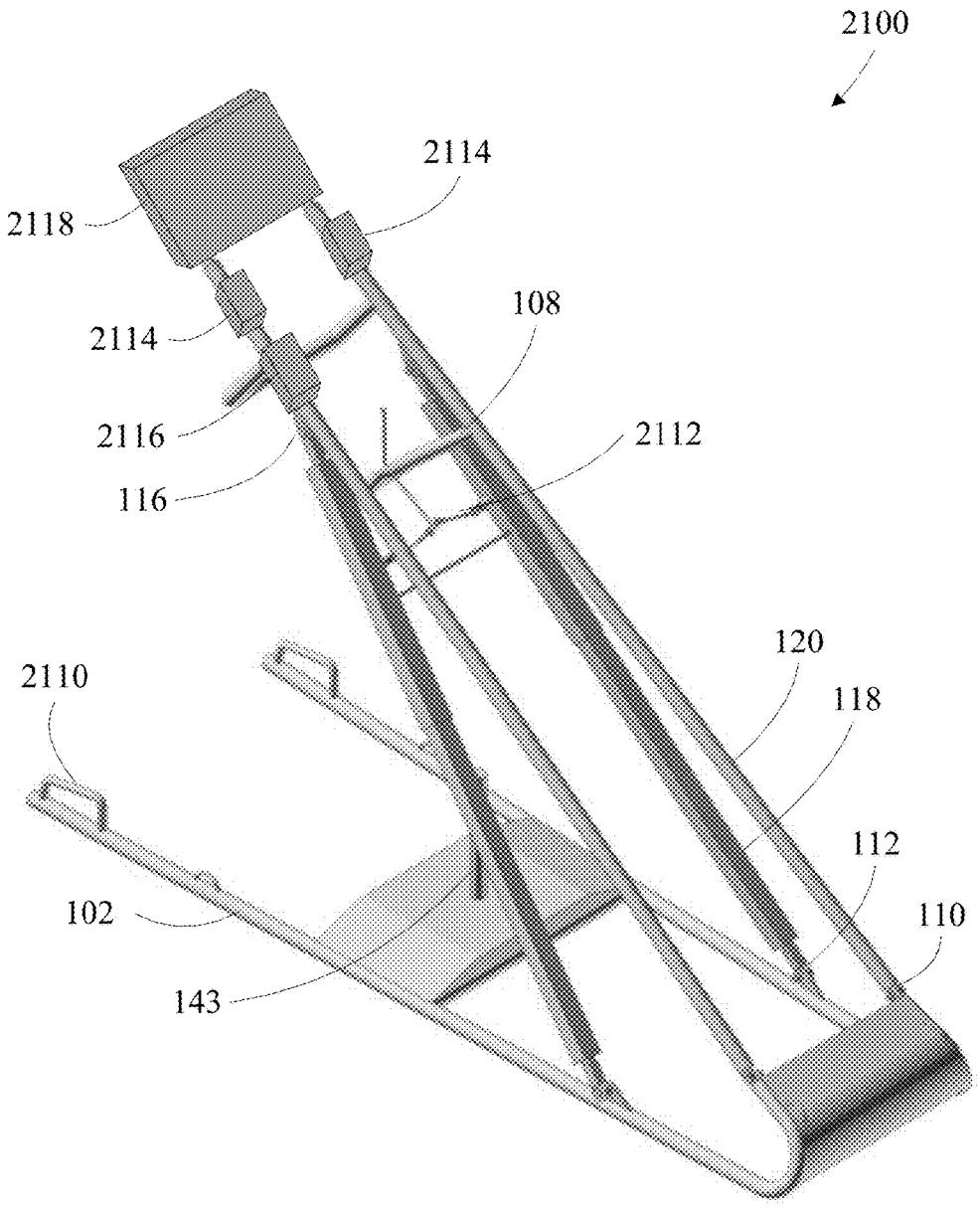
FIG. 21 depicts aspects of an embodied sled with adjustable left and right upper members and motion sensors and display.

FIG. 21 shares many aspects and components in common with the example training sled of FIG. 1, similar components share the same number. In the training sled of this embodiment 2100, there may be at least two aspects that are mechanically different from FIG. 1, the first is an expandable ball joint 2112 linking the upper member 120 to the cross member extender 118 and the second are handles 2110 connected to the friction member 102.

Figure 22:
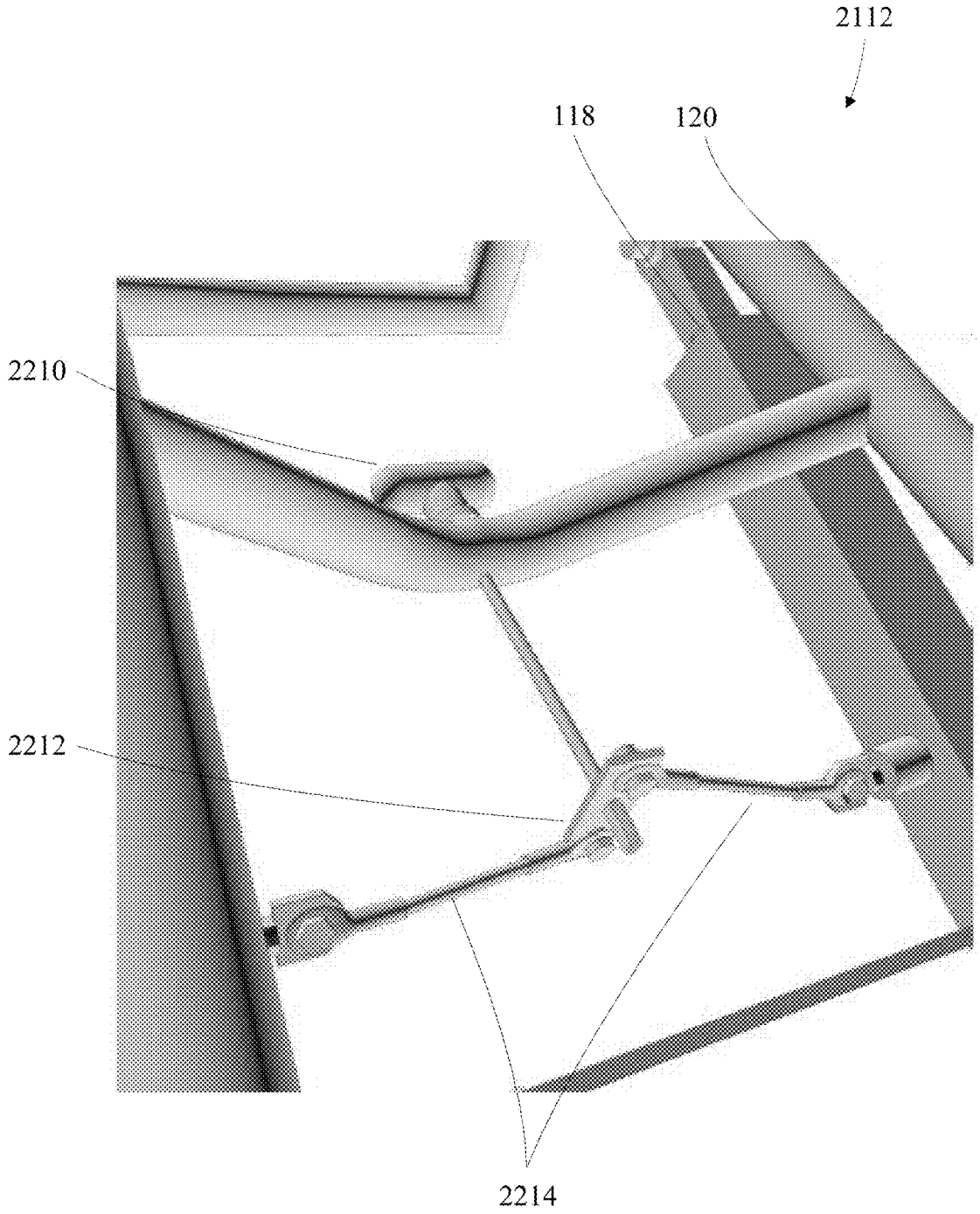
FIG. 22 depicts aspects of an embodied sled with a central adjustment member.

FIG. 22 depicts the expandable ball joint 2112. The expandable ball joint has an adjustment handle 2210 connected by a center rod to a rotation link 2212 that is rotatably coupled to two linkages 2214. The rotation link 2212 and linkages 2214 allow an adjustment of distance between the handle 2210 and the ends of the linkages. This distance adjustment affects the angle between the upper member 120 and the cross member extender 118.

The example of FIG. 21 differs also in the addition of a sensor package 2114 that is affixed to the sled. In one embodiment the sensor package houses an accelerometer. The accelerometer may be a micro-electrical mechanical accelerometer or some other type of accelerometer measurement device. In this example the sensor package is affixed to the upper member 120, but may in fact be coupled to the sled in any area. The sensor package in this example comprises the accelerometer to measure an acceleration of the training sled.

At this point it is to be understood that the accelerometer measures acceleration in at least one direction fixed by the orientation of the accelerometer within the sensor package which is affixed to the training sled. In this example the sensor package and accelerometer are thus fixed to the upper member of the training sled or to any other point on the training sled. This orientation in this example is at an angle with respect to the friction member 102 of the training sled. This offset in orientation causes the accelerometer to measure an offset acceleration.

A sensor module 2116 receives the acceleration measurement from the sensor package and may perform a series of transformations to orient the output of the accelerometer to align with the friction member 102 and if the accelerometer is a two axis accelerometer then the second axis of the two axis accelerometer may measure at least one of a transverse horizontal acceleration and a transverse vertical acceleration. If the accelerometer is a three axis accelerometer, then the second axis of the three axis accelerometer may measure a transverse horizontal acceleration and a third axis of the three axis accelerometer may measure a transverse vertical acceleration.

A Three axis accelerometer is an electromechanical device used to measure acceleration forces. Such forces may be static, like the continuous force of gravity or, as is the case with many mobile devices, dynamic to sense movement or vibrations. Acceleration is the measurement of the change in velocity divided by time, dV/dt.

A Heads Up Display (HUD) is a transparent display that presents data without requiring users to look away from their usual viewpoints.

The training sled may track the following information through the communication of the 3 axis accelerometer, HUD and may communicate via Bluetooth to a mobile app.

The accelerometers may be placed at 4 different location of the sled so that it can track various indices; these indices may be processed in the sensor module and send to the HUD and emitted via Bluetooth to a mobile device for real-time feedback.

Acceleration is a reactive force that requires enough strength and force to overcome inertia and build momentum.

Specifically the training sled may improve athletic reactive ability which is the ability to meet the ground with force while stabilizing the body enough to reduce breakdown in technique so that force can be applied during push off to create momentum. Sprinting and Plyometric exercises have been shown to be effective in improving reactive ability which the training sled is able to combine both to provide improvement. The training sled may register this amortization or reactive phase.

Forward motion force in this instance is measured as a horizontal force. The training sled will require negative shin angles to produce any movement on the sled while inhibiting any over-striding. The training sled may be able to read horizontal forces since the main movement of the sled is forward.

Stride count occurs with each foot contact and registers a spike in force application into the pad, enabling coaches to count strides.

Distance of flight is the distance from a foot lift-off to a foot contact. Determinations from acceleration and force applied the training sled may show stride length from toe off to foot contact.

Force through flight is the sled resistance each athlete will continue applying while in the air. This force applied may be important in determining horizontal forces while sprinting after the toe off.

Force through toe-off may register the forces of the final push off of the ground before the foot leaves the surface of the ground.

Force at foot contact may be measured as the amount of force that the body creates to stabilize once the foot strikes the ground following flight phase. There may be a spike in force application following the flight phase that will show how much force the foot is striking the ground with. This may be important in determining if the athlete is effective in producing enough power for sport.

Stride length is the same as distance of flight.

Starting power is the force overcoming inertia at the fastest rate possible. Force off the line. This is extremely important as many sports require the ability to overcome inertia.

Striking force is the registered force at impact when an athletes body contacts the training sled. This may be important for showing how much force an athlete can apply to a foreign object. Sports would include boxing, football, hockey etc.

Jumping Power is the amount of force required to overcome inertia sending the body airborne. Jumping power may be the same as starting power.

Landing force measurement is the amount of force that the body absorbed or creates coming down from a jump. This may be the same as force at impact. This may be important for teaching athletes how to land safely by showing techniques that minimize forces.

Maximum velocity is the highest rate of momentum for a unit of exercise.

Bounding force is a unilateral or bilateral horizontal jumping exercise that is used in developing athletic power.

The sensor package may also have a gyroscope to detect various rotations of the training sled. The gyroscope may be a micro-electrical-mechanical gyroscope or some other type of gyroscope. The gyroscope may also be connected to the training sled in a place such as the upper member, although the location is unimportant, and electrically connected to the sensor module. If the gyroscope is two axis, the first axis of the gyroscope may measure a pitch, and a second axis of the two axis gyroscope may measure at least one of a roll and a yaw. If the gyroscope has the axis, the first axis of the three axis gyroscope may measure a pitch, the second axis of the three axis gyroscope may measure a yaw, and the third axis of the three axis gyroscope may measure a roll.

The sensor package may also have a magnetometer, shown in this example as connected to the upper member 120, but again the location of attachment is unimportant. The magnetometer is also electrically connected to the sensor module. The magnetometer may measure an instantaneous heading of the training sled.

The sensor package to sensor module electrical connection may be wired or wireless. Wireless communication may take place by one of a multitude of communication methods such as local area network, WLAN, Bluetooth, and the like. Additionally, the sensor module to display electrical connection may be wired or wireless.

Figure 23:
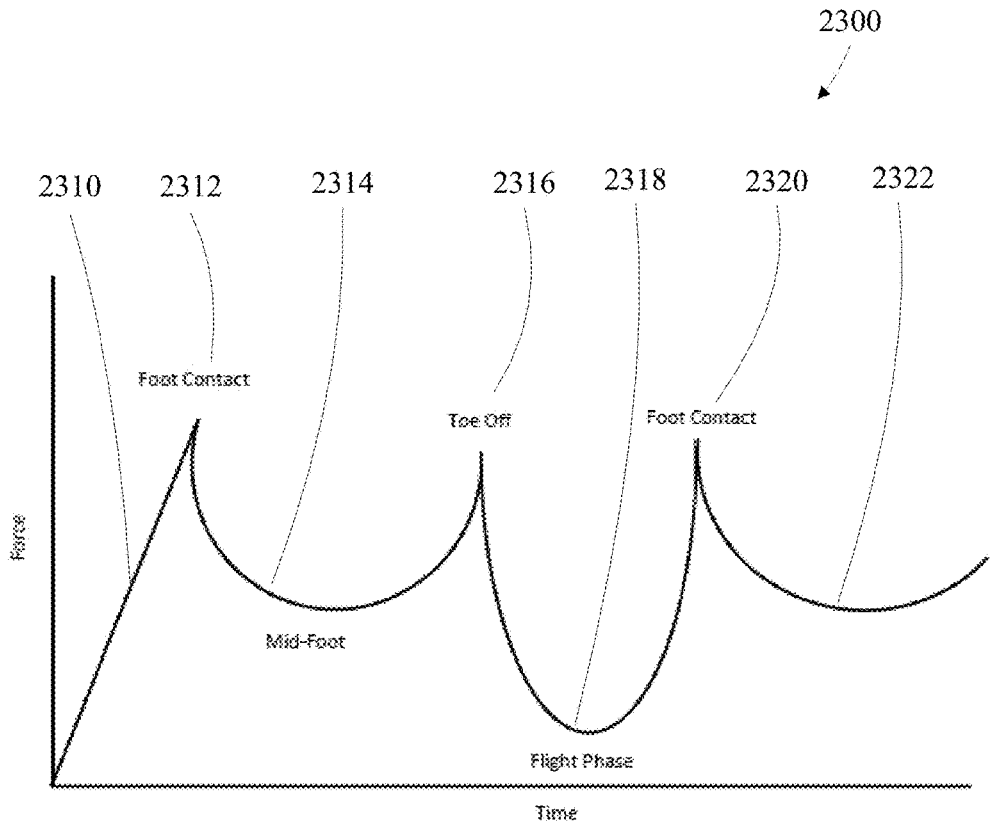
FIG. 23 depicts a force versus time display of the embodied sled as depicted in a display.

FIG. 23 depicts the output of the sensor module, determined and having converted acceleration to force transmitted to the training sled. The acceleration to force conversion may consist of two parts, a mass portion, F=MA, and a friction force at velocity. The initial impact of the player to the training sled occurs at segment 2310, initial foot contact may occur at time 2312, mid-foot planting at segment 2314, rotated toe off at time 2316, flight at segment 2318 and the next foot contact at time 2322, where the cycle repeats. This force versus time profile may be displayed as shown in 2300.

Figure 24:
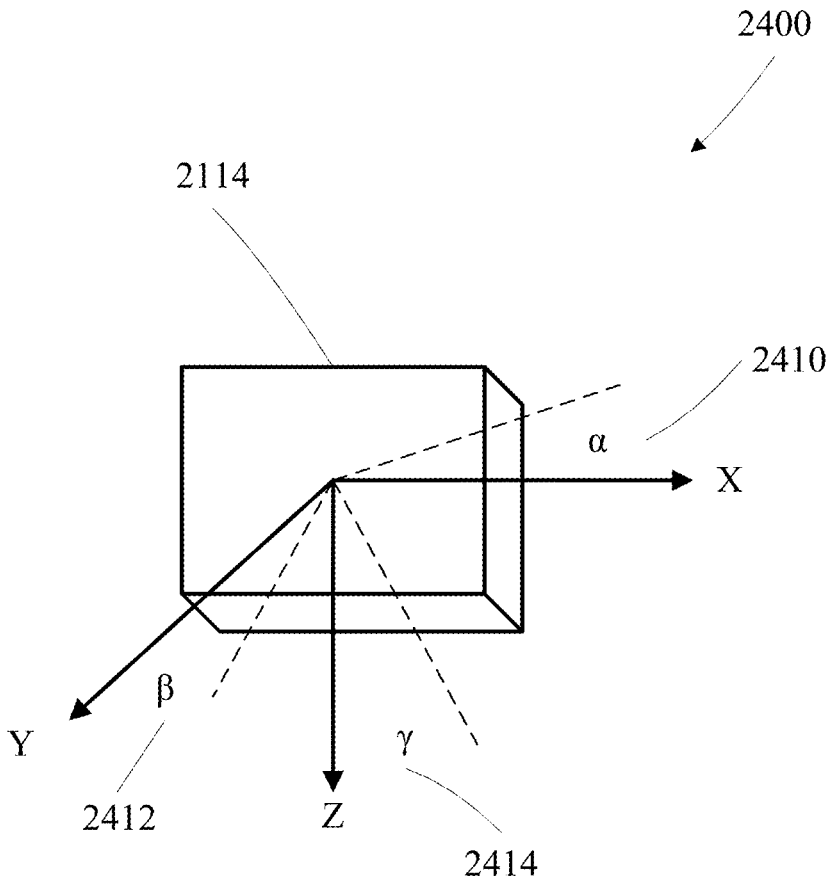
FIG. 24 depicts an embodiment of the acceleration transformation that occurs in the sensor module.

FIG. 24 depicts an example acceleration transformation 2400. The assumption for the transformation is that gravity (G) is 1.0 and is unchanging. There are three angles to be transformed in three axis accelerometer measuring Ax, Ay and Az, angle α 2410 which is the offset from the X axis angle β 2412 which is the offset from the Y axis and angle γ 2414 which is the offset from the Z axis.

$$\alpha=\arcsin(Ax/G)$$

$$\beta=\arcsin(Ay/G)$$

$$\gamma=\arccos(Az/G)$$

It is also possible to estimate a pitch and roll based solely on Ax, Ay and Az.

$$\text{Pitch}=\arctan(Ax/\sqrt{}^{-}(Ay^2+Az^2))$$

$$\text{Roll}=\arctan(Ay/\sqrt{}^{+}(Ax^2+Az^2))$$

It is understood that the sensors such as the accelerometer, gyroscope and magnetometer may be contained within a protected sensor package to prevent elemental and environmental damage to the sensors.

Figure 25:
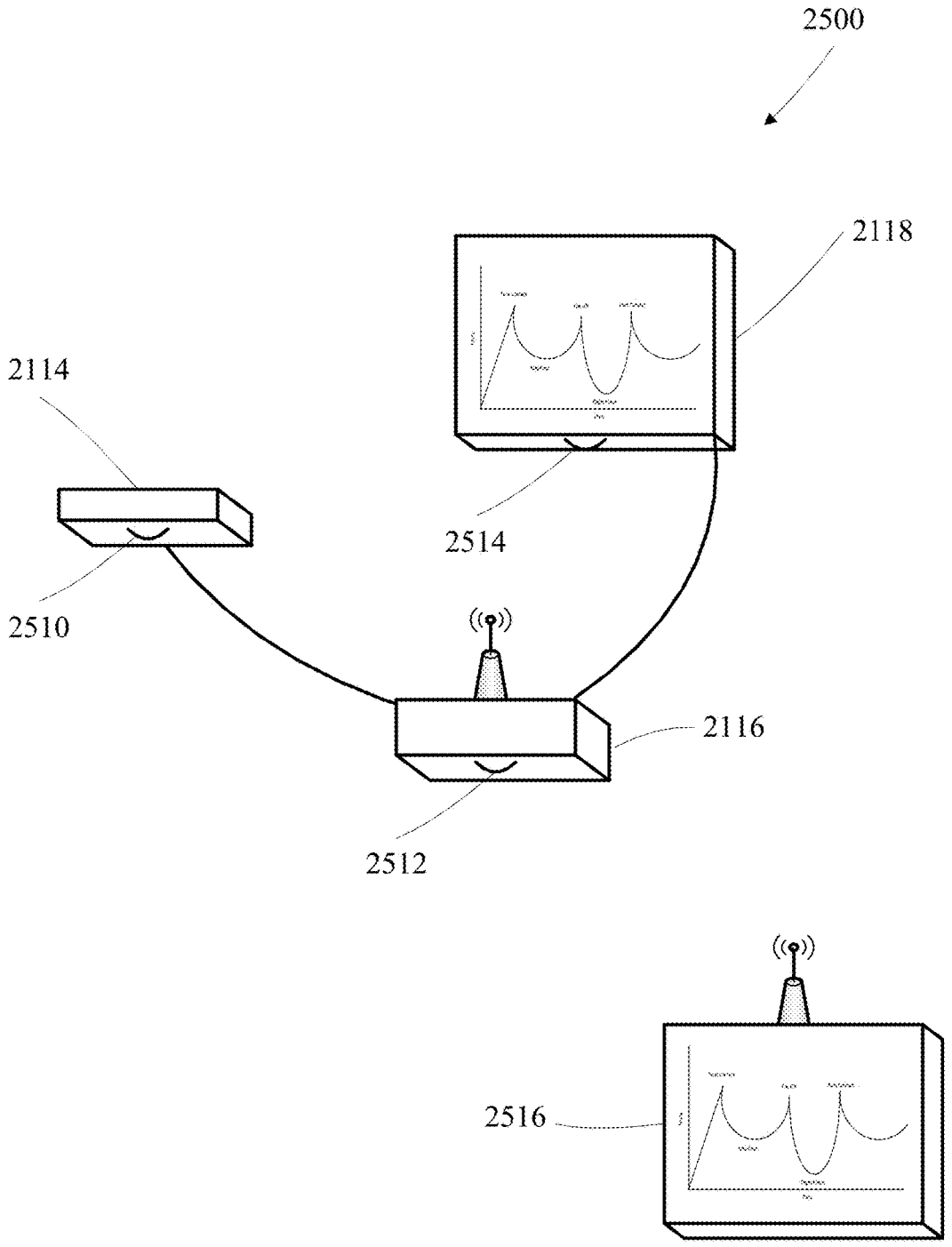
FIG. 25 depicts an embodiment of the sensor detection, resolution and reporting interconnections.

FIG. 25 depicts a sensor, sensor module and display system 2500 that are attachable to a training sled. The sensor 2114 has a first coupling 2510, such as a c-clip, band attachment, bolt or the like. The sensor module 2116 having a second coupling 2512 and the display 2118 having a third coupling 2514. The interconnections between the sensor and sensor module may be direct electrical connection or wireless connection and the interconnection between the sensor module and the display may also be direct electrical connection or wireless. In one embodiment, the sensor module has a LAN which allows the data received and determined by the sensor module to be broadcast to a sideline display 2516 for viewing by a coach or other observer.

The display 2118 may be a heads up display (HUD), a liquid crystal display or the like. In whichever embodiment configuration the display may be ruggedized to accept impacts and/or the display may have a connector or housing having a mechanical dampening to reduce the effects of impacts. The sensor module may likewise be ruggedized and/or dampened to reduce the effects of impact.

It is also understood that multiple sensors may be utilized on the training sled to measure time of impact difference from one portion of the training sled to the other, and that the sensors may determine the angle of impact, and square-ness of the impact front, i.e. was the impact lop-sided.

Patented embodiments are not necessarily restricted to embodiments described above. For example, one or more of the support members, weight holders, cross members, friction members, left and right upper members may be adjusted in an accordion manner or in a telescoping manner and can be constructed of any materials. The appended claims and elemental equivalents cover claimed embodiments.

What is claimed is:

1. A resistance training sled, comprising:

a pair of upper members, each having first and second ends and independently adjustable for length relative to each other;

a pair of friction members slidably contacting a surface and each pivotably connected to one of the second ends of the pair of upper members, respectively;

a pair of adjustable shoulder members, each pivotably positioned on one of the first ends of the pair of upper members, respectively, wherein the pair of adjustable shoulder members are adjustable to provide optimized angles with respect to the surface;

at least one extendable cross member pivotably connected between at least one of the pair of upper members and at least one of the pair of friction members, wherein the at least one extendable cross member provides support and rigidity between the at least one of the pair of friction members and the at least one of the pair of upper members, and one or more weight holders attached to at least one of the pair of friction members or the pair of upper members;

an accelerometer connected to at least one of the pair of upper members, wherein the accelerometer is utilized to measure a first acceleration of the resistance training sled;

a sensor module connected to at least one of the pair of upper members, the sensor module electrically connected to the accelerometer to determine a first directional acceleration of the resistance training sled with respect to the surface; and a display connected to at least one of the pair of upper members, the display electrically connected to the sensor module to display at least one of the first acceleration and the determined first directional acceleration.

2. The training sled of claim 1, further comprising a gyroscope connected to at least one of the pair of upper members and electrically connected to the sensor module.

3. The training sled of claim 2, wherein the gyroscope is a two axis gyroscope, wherein a first axis of the two axis gyroscope measures a pitch, and a second axis of the two axis gyroscope measures at least one of a roll and a yaw.

4. The training sled of claim 2, wherein the gyroscope is a three axis gyroscope, wherein a first axis of the three axis gyroscope measures a pitch, a second axis of the three axis gyroscope measures a yaw, and a third axis of the three axis gyroscope measures a roll.

5. The training sled of claim 1, wherein the sensor module determines a first directional force based on the first directional acceleration and records a time variation of the first directional force.

6. The training sled of claim 5, wherein the sensor module plays back the time variation of the first directional force on the display.

7. The training sled of claim 1, wherein the accelerometer is a two axis accelerometer, wherein a second axis of the two axis accelerometer measures at least one of a transverse horizontal acceleration and a transverse vertical acceleration.

8. The training sled of claim 1, wherein the accelerometer is a three axis accelerometer, wherein a second axis of the three axis accelerometer measures a transverse horizontal acceleration and a third axis of the three axis accelerometer measures a transverse vertical acceleration.

9. The training sled of claim 1, further comprising a magnetometer connected to at least one of the pair of upper members and electrically connected to the sensor module, wherein the magnetometer measures an instantaneous heading.

10. The training sled of claim 1, further comprising handles connected to the pair of friction members.

11. The training sled of claim 1, further comprising an expandable ball joint linking the at least one of the pair of upper members to the at least one extendable cross member.

12. The training sled of claim 1, wherein at least one of the accelerometer, the sensor module and the display are wireless.

13. The training sled of claim 1, further comprising a sensor package housing the accelerometer.

* * * * *